US011753889B1

(12) United States Patent
Eitschberger et al.

(10) Patent No.: US 11,753,889 B1
(45) Date of Patent: Sep. 12, 2023

(54) GAS DRIVEN WIRELINE RELEASE TOOL

(71) Applicant: DynaEnergetics Europe GmbH, Troisdorf (DE)

(72) Inventors: Christian Eitschberger, Munich (DE); Thilo Scharf, Letterkenny (IE); Gernot Uwe Burmeister, Austin, TX (US)

(73) Assignee: DynaEnergetics Europe GmbH

( * ) Notice: Subject to any disclaimer, the term of this patent is extended or adjusted under 35 U.S.C. 154(b) by 0 days.

(21) Appl. No.: 18/084,160

(22) Filed: Dec. 19, 2022

Related U.S. Application Data

(60) Provisional application No. 63/388,681, filed on Jul. 13, 2022.

(51) Int. Cl.
*E21B 23/04* (2006.01)
*E21B 47/12* (2012.01)

(52) U.S. Cl.
CPC ..... *E21B 23/0417* (2020.05); *E21B 47/12* (2013.01)

(58) Field of Classification Search
CPC ... E21B 23/0414; E21B 23/04; E21B 23/0417
See application file for complete search history.

(56) References Cited

U.S. PATENT DOCUMENTS 1,757,288 A 5/1930 Bleecker
2,142,572 A 1/1939 Metzner
2,216,359 A 10/1940 Spencer
2,228,873 A 1/1941 Hardt et al.
2,252,270 A 8/1941 Miller
2,264,450 A 12/1941 Mounce
2,308,004 A 1/1943 Hart
(Continued)

FOREIGN PATENT DOCUMENTS

CA 2021396 A1 1/1991
CA 2003166 A1 5/1991
(Continued)

OTHER PUBLICATIONS

Thru-Tubing Systems, Series 1200—Auto Release Tool, www.thrutubingsystems.com/intervention-products-and-services.php?product=/wireline-products/series-1200-auto-release-tool, 2003, 2 pages.

(Continued)

*Primary Examiner* — Shane Bomar
(74) *Attorney, Agent, or Firm* — Womble Bond Dickinson (US) LLP

(57) ABSTRACT

According to some embodiments, systems and methods of releasing a wireline from a tool string in a well are presented. For example, a wireline release tool may include a first housing portion and a second housing portion. The first housing portion may have a closed end, an open end, and a chamber therebetween, and the second housing portion may be shearably attached to close the open end of the first housing portion. A gas generator may be disposed in the chamber and may be capable of generating gas pressure in the chamber sufficient to overcome a pressure differential between the chamber and the external wellbore environment and to force the second housing portion from an initial position to a release position. One of the housing portions may be configured for attachment to a wireline, while the other of the housing portions may be configured for attachment to a tool string.

20 Claims, 10 Drawing Sheets

(56) References Cited

U.S. PATENT DOCUMENTS 2,326,406 A 8/1943 Lloyd
2,358,466 A 9/1944 Miller
2,418,486 A 4/1947 Smylie
2,462,784 A 2/1949 Smith
2,519,116 A 8/1950 Crake
2,543,814 A 3/1951 Thompson et al.
2,598,651 A 5/1952 Spencer
2,618,343 A 11/1952 Conrad
2,637,402 A 5/1953 Baker et al.
2,640,547 A 6/1953 Baker et al.
2,644,530 A 7/1953 Baker
2,649,046 A 8/1953 Oliver
2,655,993 A 10/1953 Lloyd
2,681,114 A 6/1954 Conrad
2,692,023 A 10/1954 Conrad
2,695,064 A 11/1954 Ragan et al.
2,696,259 A 12/1954 Greene
2,701,614 A * 2/1955 Ragan ..... E21B 23/065 166/123
2,708,408 A 5/1955 Sweetman
2,713,910 A 7/1955 Baker et al.
2,742,856 A 4/1956 Fieser et al.
2,761,384 A 9/1956 Sweetman
2,765,739 A 10/1956 Mohaupt et al.
2,766,690 A 10/1956 Lebourg
2,769,701 A 11/1956 Frederick
2,799,343 A 7/1957 Conrad
2,807,325 A 9/1957 Webb
2,815,816 A 12/1957 Baker
2,873,675 A 2/1959 Lebourg
2,889,775 A 6/1959 Owen
2,906,339 A 9/1959 Griffin
2,979,904 A 4/1961 Royer
2,996,591 A 8/1961 Thomas
3,024,843 A 3/1962 Dean
3,026,939 A 3/1962 Sweetman
331,964 A 5/1962 Chesnut
3,036,636 A 5/1962 Clark
3,040,659 A 6/1962 Mcculleugh
3,055,430 A 9/1962 Campbell
3,076,507 A 2/1963 Sweetman
3,080,005 A 3/1963 Porter
3,094,166 A 6/1963 Mccullough
3,128,702 A 4/1964 Christopher
3,140,537 A 7/1964 Popoff
3,155,164 A 11/1964 Keener
3,160,209 A 12/1964 Bonner
3,170,400 A 2/1965 Nelson
3,173,992 A 3/1965 Boop
3,186,485 A 6/1965 Owen
RE25,846 E 8/1965 Campbell
3,209,692 A 10/1965 George
3,211,093 A 10/1965 Mccullough et al.
3,211,222 A 10/1965 Myers
3,220,480 A 11/1965 Myers
3,233,674 A 2/1966 Kurt
3,244,232 A 4/1966 Myers
3,246,707 A 4/1966 Bell
3,264,989 A 8/1966 Rucker
3,264,994 A 8/1966 Kurt
3,266,575 A 8/1966 Owen
3,298,437 A 1/1967 Conrad
3,303,884 A 2/1967 Medford
3,320,884 A 5/1967 Kowalick et al.
3,327,792 A 6/1967 Boop
3,361,204 A 1/1968 Howard et al.
3,366,179 A 1/1968 Kinley et al.
3,374,735 A 3/1968 Moore
3,398,803 A 8/1968 Kurt et al.
3,414,071 A 12/1968 Alberts
3,415,321 A 12/1968 Venghiattis
3,498,376 A 3/1970 Sizer et al.
3,504,723 A 4/1970 Cushman et al.
3,621,916 A 11/1971 Smith, Jr.
3,630,284 A 12/1971 Fast et al.
3,650,212 A 3/1972 Bauer
3,659,658 A 5/1972 Brieger
3,669,190 A 6/1972 Sizer et al.
3,691,954 A 9/1972 Kern
3,712,376 A 1/1973 Young et al.
3,762,470 A 10/1973 Eggleston
3,859,921 A 1/1975 Stephenson
4,003,433 A 1/1977 Goins
4,007,790 A 2/1977 Henning
4,007,796 A 2/1977 Boop
4,034,673 A 7/1977 Schneider, Jr.
4,058,061 A 11/1977 Mansur, Jr. et al.
4,064,935 A 12/1977 Mohaupt
4,071,096 A 1/1978 Dines
4,080,898 A 3/1978 Gieske
4,084,147 A 4/1978 Mlyniec et al.
4,085,397 A 4/1978 Yagher
4,132,171 A 1/1979 Pawlak et al.
4,140,188 A 2/1979 Vann
4,172,421 A 10/1979 Regalbuto
4,182,216 A 1/1980 DeCaro
4,208,966 A 6/1980 Hart
4,216,721 A 8/1980 Marziano et al.
4,250,960 A 2/1981 Chammas
4,261,263 A 4/1981 Coultas et al.
4,266,613 A 5/1981 Boop
4,269,120 A 5/1981 Brede et al.
4,284,235 A 8/1981 Diermayer et al.
4,290,486 A 9/1981 Regalbuto
4,306,628 A 12/1981 Adams, Jr. et al.
4,317,413 A 3/1982 Strandli et al.
4,319,526 A 3/1982 DerMott
4,345,646 A 8/1982 Terrell
4,387,773 A 6/1983 McPhee
4,393,946 A 7/1983 Pottier et al.
4,429,741 A 2/1984 Hyland
4,430,939 A 2/1984 Harrold
4,457,383 A 7/1984 Boop
4,485,741 A 12/1984 Moore et al.
4,491,185 A 1/1985 McClure
4,496,008 A 1/1985 Pottier et al.
4,512,418 A 4/1985 Regalbuto et al.
4,523,649 A 6/1985 Stout
4,523,650 A 6/1985 Sehnert et al.
4,530,396 A 7/1985 Mohaupt
4,535,842 A 8/1985 Ross
4,541,486 A 9/1985 Wetzel et al.
4,566,544 A 1/1986 Bagley et al.
4,574,892 A 3/1986 Grigar et al.
4,576,233 A 3/1986 George
4,583,602 A 4/1986 Ayers
4,598,775 A 7/1986 Vann et al.
4,605,074 A 8/1986 Barfield
4,609,056 A 9/1986 Colle, Jr. et al.
4,617,997 A 10/1986 Jennings, Jr.
4,619,318 A 10/1986 Terrell et al.
4,619,320 A 10/1986 Adnyana et al.
4,620,591 A 11/1986 Terrell et al.
4,621,396 A 11/1986 Walker et al.
4,637,478 A 1/1987 George
4,640,354 A 2/1987 Boisson
4,643,097 A 2/1987 Chawla et al.
4,657,089 A 4/1987 Stout
4,660,910 A 4/1987 Sharp et al.
4,662,450 A 5/1987 Haugen
4,747,201 A 5/1988 Donovan et al.
4,753,170 A 6/1988 Regalbuto et al.
4,754,812 A 7/1988 Gentry
4,756,363 A 7/1988 Lanmon et al.
4,766,813 A 8/1988 Winter et al.
4,776,393 A 10/1988 Forehand et al.
4,790,383 A 12/1988 Savage et al.
4,796,708 A 1/1989 Lembcke
4,798,244 A 1/1989 Trost
4,800,815 A 1/1989 Appledorn et al.
4,830,120 A 5/1989 Stout
4,840,231 A 6/1989 Berzin et al.
4,852,647 A 8/1989 Mohaupt
4,859,196 A 8/1989 Durando et al.

(56) References Cited

U.S. PATENT DOCUMENTS

| | | | |
|---|---|---|---|
| 4,869,325 | A | 9/1989 | Halbardier |
| 4,889,183 | A | 12/1989 | Sommers et al. |
| 5,024,270 | A | 6/1991 | Bostick |
| 5,027,708 | A | 7/1991 | Gonzalez et al. |
| 5,042,594 | A | 8/1991 | Gonzalez et al. |
| 5,046,567 | A | 9/1991 | Aitken et al. |
| 5,052,489 | A | 10/1991 | Carisella et al. |
| 5,060,573 | A | 10/1991 | Montgomery et al. |
| 5,070,788 | A | 12/1991 | Carisella et al. |
| 5,088,413 | A | 2/1992 | Huber |
| 5,090,324 | A | 2/1992 | Bocker et al. |
| 5,105,742 | A | 4/1992 | Sumner |
| 5,119,729 | A | 6/1992 | Nguyen |
| 5,155,293 | A | 10/1992 | Barton |
| 5,155,296 | A | 10/1992 | Michaluk |
| 5,159,145 | A | 10/1992 | Carisella et al. |
| 5,165,489 | A | 11/1992 | Langston |
| 5,204,491 | A | 4/1993 | Aureal et al. |
| 5,211,224 | A | 5/1993 | Bouldin |
| 5,216,197 | A | 6/1993 | Huber et al. |
| 5,303,772 | A | 4/1994 | George et al. |
| 5,316,087 | A | 5/1994 | Manke et al. |
| 5,322,019 | A | 6/1994 | Hyland |
| 5,346,014 | A | 9/1994 | Ross |
| 5,347,929 | A | 9/1994 | Lerche et al. |
| 5,366,013 | A | 11/1994 | Edwards et al. |
| 5,379,845 | A | 1/1995 | Blount et al. |
| 5,392,860 | A | 2/1995 | Ross |
| 5,396,951 | A | 3/1995 | Ross |
| 5,398,753 | A | 3/1995 | Obrejanu et al. |
| 5,398,760 | A | 3/1995 | George et al. |
| 5,436,791 | A | 7/1995 | Turano et al. |
| 5,447,202 | A | 9/1995 | Littleford |
| 5,456,319 | A | 10/1995 | Schmidt et al. |
| 5,479,860 | A | 1/1996 | Ellis |
| 5,501,606 | A | 3/1996 | Oda et al. |
| 5,503,077 | A | 4/1996 | Motley |
| 5,509,480 | A | 4/1996 | Terrell et al. |
| 5,511,620 | A | 4/1996 | Baugh et al. |
| 5,551,346 | A | 9/1996 | Walters et al. |
| 5,551,520 | A | 9/1996 | Bethel et al. |
| 5,571,986 | A | 11/1996 | Snider et al. |
| 5,575,331 | A | 11/1996 | Terrell |
| 5,603,384 | A | 2/1997 | Bethel et al. |
| 5,703,319 | A | 12/1997 | Fritz et al. |
| 5,732,869 | A | 3/1998 | Hirtl |
| 5,756,926 | A | 5/1998 | Bonbrake et al. |
| 5,775,426 | A | 7/1998 | Snider et al. |
| 5,778,979 | A | 7/1998 | Burleson et al. |
| 5,803,175 | A | 9/1998 | Myers, Jr. et al. |
| 5,816,343 | A | 10/1998 | Markel et al. |
| 5,823,266 | A | 10/1998 | Burleson et al. |
| 5,831,204 | A | 11/1998 | Lubben et al. |
| 5,871,052 | A | 2/1999 | Benson et al. |
| 5,911,277 | A | 6/1999 | Hromas et al. |
| 5,984,006 | A | 11/1999 | Read et al. |
| 5,992,289 | A | 11/1999 | George et al. |
| 5,992,523 | A | 11/1999 | Burleson et al. |
| 6,006,833 | A | 12/1999 | Burleson et al. |
| 6,012,525 | A | 1/2000 | Burleson et al. |
| 6,032,733 | A | 3/2000 | Ludwig et al. |
| 6,082,450 | A | 7/2000 | Snider et al. |
| 6,085,659 | A | 7/2000 | Beukes et al. |
| 6,102,120 | A | 8/2000 | Chen et al. |
| 6,112,666 | A | 9/2000 | Murray et al. |
| 6,164,375 | A | 12/2000 | Carisella |
| 6,227,116 | B1 | 5/2001 | Dumenko |
| 6,272,782 | B1 | 8/2001 | Dittrich et al. |
| 6,295,912 | B1 | 10/2001 | Burleson et al. |
| 6,298,915 | B1 | 10/2001 | George |
| 6,305,287 | B1 | 10/2001 | Capers et al. |
| 6,349,767 | B2 | 2/2002 | Gissler |
| 6,354,374 | B1 | 3/2002 | Edwards et al. |
| 6,385,031 | B1 | 5/2002 | Lerche et al. |
| 6,412,415 | B1 | 7/2002 | Kothari et al. |
| 6,414,905 | B1 | 7/2002 | Owens et al. |
| 6,418,853 | B1 | 7/2002 | Duguet et al. |
| 6,431,269 | B1 | 8/2002 | Post et al. |
| 6,435,096 | B1 | 8/2002 | Watson |
| 6,467,387 | B1 | 10/2002 | Espinosa et al. |
| 6,502,736 | B2 | 1/2003 | Dittrich et al. |
| 6,506,083 | B1 | 1/2003 | Bickford et al. |
| 6,571,906 | B2 | 6/2003 | Jones et al. |
| 6,582,251 | B1 | 6/2003 | Burke et al. |
| 6,591,753 | B1 | 7/2003 | Schmid et al. |
| 6,618,237 | B2 | 9/2003 | Eddy et al. |
| 6,651,747 | B2 | 11/2003 | Chen et al. |
| 6,675,896 | B2 | 1/2004 | George |
| 6,679,327 | B2 | 1/2004 | Sloan et al. |
| 6,702,009 | B1 | 3/2004 | Drury et al. |
| 6,719,061 | B2 | 4/2004 | Muller et al. |
| 6,739,265 | B1 | 5/2004 | Badger et al. |
| 6,742,602 | B2 | 6/2004 | Trotechaud |
| 6,752,083 | B1 | 6/2004 | Lerche et al. |
| 6,763,883 | B2 | 7/2004 | Green et al. |
| 6,817,298 | B1 | 11/2004 | Zharkov et al. |
| 6,843,317 | B2 | 1/2005 | Mackenzie |
| 6,880,637 | B2 | 4/2005 | Myers, Jr. et al. |
| 6,966,378 | B2 | 11/2005 | Hromas et al. |
| 7,017,672 | B2 | 3/2006 | Owen |
| 7,066,280 | B2 | 6/2006 | Sullivan et al. |
| 7,073,589 | B2 | 7/2006 | Tiernan et al. |
| 7,086,481 | B2 | 8/2006 | Hosie et al. |
| 7,104,323 | B2 | 9/2006 | Cook et al. |
| 7,107,908 | B2 | 9/2006 | Forman et al. |
| 7,128,162 | B2 | 10/2006 | Quinn |
| 7,193,527 | B2 | 3/2007 | Hall |
| 7,228,906 | B2 | 6/2007 | Snider et al. |
| 7,237,626 | B2 | 7/2007 | Gurjar et al. |
| 7,243,722 | B2 | 7/2007 | Oosterling et al. |
| 7,246,548 | B2 | 7/2007 | Kash |
| 7,278,482 | B2 | 10/2007 | Azar |
| 7,278,491 | B2 | 10/2007 | Scott |
| 7,347,278 | B2 | 3/2008 | Lerche et al. |
| 7,364,451 | B2 | 4/2008 | Ring et al. |
| 7,373,974 | B2 | 5/2008 | Connell et al. |
| 7,387,162 | B2 | 6/2008 | Mooney, Jr. et al. |
| 7,428,932 | B1 | 9/2008 | Wintill et al. |
| 7,431,075 | B2 | 10/2008 | Brooks et al. |
| 7,455,104 | B2 | 11/2008 | Duhon et al. |
| 7,487,827 | B2 | 2/2009 | Tiernan |
| 7,493,945 | B2 | 2/2009 | Doane et al. |
| 7,510,017 | B2 | 3/2009 | Howell et al. |
| 7,533,722 | B2 | 5/2009 | George et al. |
| 7,568,429 | B2 | 8/2009 | Hummel et al. |
| 7,574,960 | B1 | 8/2009 | Dockery et al. |
| 7,604,062 | B2 | 10/2009 | Murray |
| 7,661,474 | B2 | 2/2010 | Campbell et al. |
| 7,721,650 | B2 | 5/2010 | Barton et al. |
| 7,748,457 | B2 | 7/2010 | Walton et al. |
| 7,762,172 | B2 | 7/2010 | Li et al. |
| 7,762,331 | B2 | 7/2010 | Goodman et al. |
| 7,762,351 | B2 | 7/2010 | Vidal |
| 7,778,006 | B2 | 8/2010 | Stewart et al. |
| 7,779,926 | B2 | 8/2010 | Turley et al. |
| 7,810,430 | B2 | 10/2010 | Chan et al. |
| 7,823,508 | B2 | 11/2010 | Anderson et al. |
| 7,845,431 | B2 | 12/2010 | Eriksen et al. |
| 7,896,077 | B2 | 3/2011 | Behrmann et al. |
| 7,901,247 | B2 | 3/2011 | Ring |
| 7,905,290 | B2 | 3/2011 | Schicks |
| 7,908,970 | B1 | 3/2011 | Jakaboski et al. |
| 7,929,270 | B2 | 4/2011 | Hummel et al. |
| 7,934,453 | B2 | 5/2011 | Moore |
| 7,980,874 | B2 | 7/2011 | Finke et al. |
| 8,066,083 | B2 | 11/2011 | Hales et al. |
| 8,069,789 | B2 | 12/2011 | Hummel et al. |
| 8,074,737 | B2 | 12/2011 | Hill et al. |
| 8,091,477 | B2 | 1/2012 | Brooks et al. |
| 8,127,846 | B2 | 3/2012 | Hill et al. |
| 8,141,639 | B2 | 3/2012 | Gartz et al. |
| 8,157,022 | B2 | 4/2012 | Bertoja et al. |
| 8,181,718 | B2 | 5/2012 | Burleson et al. |
| 8,182,212 | B2 | 5/2012 | Parcell |

(56) References Cited

U.S. PATENT DOCUMENTS

| | | | |
|---|---|---|---|
| 8,186,259 | B2 | 5/2012 | Burleson et al. |
| 8,186,425 | B2 | 5/2012 | Smart et al. |
| 8,230,932 | B2 | 7/2012 | Ratcliffe et al. |
| 8,230,946 | B2 | 7/2012 | Crawford et al. |
| 8,256,337 | B2 | 9/2012 | Hill et al. |
| 8,264,814 | B2 | 9/2012 | Love et al. |
| 8,281,851 | B2 | 10/2012 | Spence |
| 8,322,413 | B2 | 12/2012 | Bishop et al. |
| 8,322,426 | B2 | 12/2012 | Wright et al. |
| 8,387,533 | B2 | 3/2013 | Runkel |
| 8,395,878 | B2 | 3/2013 | Stewart et al. |
| 8,397,741 | B2 | 3/2013 | Bisset |
| 8,443,915 | B2 | 5/2013 | Storm, Jr. et al. |
| 8,451,137 | B2 | 5/2013 | Bonavides et al. |
| 8,464,624 | B2 | 6/2013 | Asahina et al. |
| 8,468,944 | B2 | 6/2013 | Givens et al. |
| 8,474,381 | B2 | 7/2013 | Streibich et al. |
| 8,474,533 | B2 | 7/2013 | Miller et al. |
| 8,479,830 | B2 | 7/2013 | Denoix et al. |
| D689,590 | S | 9/2013 | Brose |
| 8,522,863 | B2 | 9/2013 | Tiernan et al. |
| 8,540,021 | B2 | 9/2013 | McCarter et al. |
| 8,561,683 | B2 | 10/2013 | Wood et al. |
| 8,576,090 | B2 | 11/2013 | Lerche et al. |
| 8,661,978 | B2 | 3/2014 | Backhus et al. |
| 8,689,868 | B2 | 4/2014 | Lerche et al. |
| 8,695,506 | B2 | 4/2014 | Lanclos |
| 8,695,716 | B2 | 4/2014 | Ravensbergen |
| 8,752,486 | B2 | 6/2014 | Robertson et al. |
| 8,752,650 | B2 | 6/2014 | Gray |
| 8,770,271 | B2 | 7/2014 | Fielder et al. |
| 8,826,821 | B2 | 9/2014 | Martin |
| 8,833,441 | B2 | 9/2014 | Fielder et al. |
| 8,863,665 | B2 | 10/2014 | DeVries et al. |
| 8,869,887 | B2 | 10/2014 | Deere et al. |
| 8,875,787 | B2 | 11/2014 | Tassaroli |
| 8,875,796 | B2 | 11/2014 | Hales et al. |
| 8,881,816 | B2 | 11/2014 | Glenn et al. |
| 8,881,836 | B2 | 11/2014 | Ingram |
| 8,884,778 | B2 | 11/2014 | Lerche et al. |
| 8,931,569 | B2 | 1/2015 | Fagley et al. |
| 8,943,943 | B2 | 2/2015 | Tassaroli |
| 8,950,480 | B1 | 2/2015 | Strickland |
| 8,960,093 | B2 | 2/2015 | Preiss et al. |
| 8,991,489 | B2 | 3/2015 | Redlinger et al. |
| 9,057,261 | B2 | 6/2015 | Walters et al. |
| 9,065,201 | B2 | 6/2015 | Borgfeld et al. |
| 9,080,405 | B2 | 7/2015 | Carisella |
| 9,080,433 | B2 | 7/2015 | Lanclos et al. |
| 9,145,764 | B2 | 9/2015 | Burton et al. |
| 9,175,553 | B2 | 11/2015 | McCann et al. |
| 9,181,790 | B2 | 11/2015 | Mace et al. |
| 9,182,199 | B2 | 11/2015 | Skidmore et al. |
| 9,194,219 | B1 | 11/2015 | Hardesty et al. |
| 9,222,331 | B2 | 12/2015 | Schneidmiller et al. |
| 9,270,051 | B1 | 2/2016 | Christiansen et al. |
| 9,284,819 | B2 | 3/2016 | Tolman et al. |
| 9,285,199 | B2 | 3/2016 | Beikoff |
| 9,328,559 | B2 | 5/2016 | Schwarz et al. |
| 9,441,465 | B2 | 9/2016 | Tassaroli |
| 9,453,381 | B2 | 9/2016 | Moyes |
| 9,453,382 | B2 | 9/2016 | Carr et al. |
| 9,464,495 | B2 | 10/2016 | Picciotti et al. |
| 9,476,272 | B2 | 10/2016 | Carisella et al. |
| 9,476,275 | B2 | 10/2016 | Wells et al. |
| 9,476,289 | B2 | 10/2016 | Wells |
| 9,482,069 | B2 | 11/2016 | Powers |
| 9,488,024 | B2 | 11/2016 | Hoffman et al. |
| 9,494,021 | B2 | 11/2016 | Parks et al. |
| 9,506,316 | B2 | 11/2016 | Carr et al. |
| 9,523,271 | B2 | 12/2016 | Bonavides et al. |
| 9,581,422 | B2 | 2/2017 | Preiss et al. |
| 9,587,439 | B2 | 3/2017 | Lamik-Thonhauser et al. |
| 9,587,466 | B2 | 3/2017 | Burguieres et al. |
| 9,598,942 | B2 | 3/2017 | Wells et al. |
| 9,605,937 | B2 | 3/2017 | Eitschberger et al. |
| 9,677,363 | B2 | 6/2017 | Schacherer et al. |
| 9,689,223 | B2 | 6/2017 | Schacherer et al. |
| 9,689,240 | B2 | 6/2017 | LaGrange et al. |
| 9,695,673 | B1 | 7/2017 | Latiolais |
| 9,702,211 | B2 | 7/2017 | Tinnen |
| 9,702,680 | B2 | 7/2017 | Parks et al. |
| 9,709,373 | B2 | 7/2017 | Hikone et al. |
| 9,732,561 | B2 | 8/2017 | Carter, Jr. |
| 9,771,769 | B2 | 9/2017 | Baker et al. |
| 9,784,549 | B2 | 10/2017 | Eitschberger |
| 9,810,035 | B1 | 11/2017 | Carr et al. |
| 9,810,048 | B2 | 11/2017 | Balun |
| 9,822,596 | B2 | 11/2017 | Clemens et al. |
| 9,822,609 | B2 | 11/2017 | Wright et al. |
| 9,822,618 | B2 | 11/2017 | Eitschberger |
| 9,835,006 | B2 | 12/2017 | George et al. |
| 9,835,428 | B2 | 12/2017 | Mace et al. |
| 9,879,501 | B2 | 1/2018 | Hammer et al. |
| 9,890,604 | B2 | 2/2018 | Wood et al. |
| 9,903,192 | B2 | 2/2018 | Entchev et al. |
| 9,909,376 | B2 | 3/2018 | Hrametz et al. |
| 9,926,750 | B2 | 3/2018 | Ringgenberg |
| 9,926,765 | B2 | 3/2018 | Goodman et al. |
| 9,963,398 | B2 | 5/2018 | Greeley et al. |
| 9,995,115 | B2 | 6/2018 | Kasperski |
| 10,018,018 | B2 | 7/2018 | Cannon et al. |
| 10,036,236 | B1 | 7/2018 | Sullivan et al. |
| 10,041,321 | B2 | 8/2018 | Oag et al. |
| 10,066,921 | B2 | 9/2018 | Eitschberger |
| 10,077,626 | B2 | 9/2018 | Xu et al. |
| 10,077,641 | B2 | 9/2018 | Rogman et al. |
| 10,087,708 | B2 | 10/2018 | Al-Gouhi et al. |
| 10,100,612 | B2 | 10/2018 | Lisowski et al. |
| 10,107,054 | B2 | 10/2018 | Drury et al. |
| 10,138,713 | B2 | 11/2018 | Tolman et al. |
| 10,151,180 | B2 | 12/2018 | Robey et al. |
| 10,151,181 | B2 | 12/2018 | Lopez et al. |
| 10,167,691 | B2 | 1/2019 | Zhang et al. |
| 10,188,990 | B2 | 1/2019 | Burmeister et al. |
| 10,190,398 | B2 | 1/2019 | Goodman et al. |
| 10,246,961 | B2 | 4/2019 | Robertson et al. |
| 10,267,603 | B2 | 4/2019 | Marshall et al. |
| 10,273,788 | B2 | 4/2019 | Bradley et al. |
| 10,309,199 | B2 | 6/2019 | Eitschberger |
| 10,337,270 | B2 | 7/2019 | Carisella et al. |
| 10,352,136 | B2 | 7/2019 | Goyeneche |
| 10,352,144 | B2 | 7/2019 | Entchev et al. |
| 10,365,079 | B2 | 7/2019 | Harrington et al. |
| 10,393,482 | B2 | 8/2019 | Khatiwada et al. |
| 10,428,595 | B2 | 10/2019 | Bradley et al. |
| 10,429,161 | B2 | 10/2019 | Parks et al. |
| 10,443,331 | B1 | 10/2019 | Andres et al. |
| 10,458,213 | B1 | 10/2019 | Eitschberger et al. |
| 10,538,981 | B2 | 1/2020 | Covalt et al. |
| 10,594,102 | B2 | 3/2020 | Pratt et al. |
| 10,605,018 | B2 | 3/2020 | Schmidt et al. |
| 10,669,822 | B2 | 6/2020 | Eitschberger |
| 10,689,931 | B2 | 6/2020 | Mickey et al. |
| 10,794,122 | B2 | 10/2020 | Kitchen et al. |
| 10,830,566 | B2 | 11/2020 | Maxted et al. |
| 10,844,678 | B2 | 11/2020 | Mickey et al. |
| 10,883,327 | B1 | 1/2021 | Drury et al. |
| 10,900,309 | B2 | 1/2021 | Robertson et al. |
| 10,927,627 | B2 | 2/2021 | Eitschberger et al. |
| 10,934,795 | B2 | 3/2021 | Wells |
| 10,941,625 | B2 | 3/2021 | Mickey |
| 11,021,923 | B2 * | 6/2021 | Mulhern ..... E21B 23/04 |
| 11,053,759 | B2 | 7/2021 | Covalt et al. |
| 11,053,760 | B2 | 7/2021 | Baker et al. |
| 11,136,866 | B2 | 10/2021 | Holodnak et al. |
| 11,255,147 | B2 | 2/2022 | Eitschberger et al. |
| 11,306,547 | B2 | 4/2022 | Thomas |
| 11,306,556 | B2 | 4/2022 | Price |
| 2002/0020320 | A1 | 2/2002 | Lebaudy et al. |
| 2002/0062991 | A1 | 5/2002 | Farrant et al. |
| 2002/0129940 | A1 | 9/2002 | Yang et al. |
| 2003/0000411 | A1 | 1/2003 | Cernocky et al. |
| 2003/0001753 | A1 | 1/2003 | Cernocky et al. |

(56) References Cited

U.S. PATENT DOCUMENTS

2003/0155112 A1 8/2003 Tiernan et al.
2004/0141279 A1 7/2004 Amano et al.
2005/0178282 A1 8/2005 Brooks et al.
2005/0183610 A1 8/2005 Barton et al.
2005/0186823 A1 8/2005 Ring et al.
2005/0194146 A1 9/2005 Barker et al.
2005/0229805 A1 10/2005 Myers, Jr. et al.
2006/0048664 A1 3/2006 Tieran et al.
2006/0075890 A1 4/2006 Tieran
2006/0081374 A1 4/2006 Bland et al.
2006/0082152 A1 4/2006 Neves
2007/0079966 A1 4/2007 George et al.
2007/0084336 A1 4/2007 Neves
2007/0089911 A1* 4/2007 Moyes ..... E21B 23/04 175/93
2007/0125540 A1 6/2007 Gerez et al.
2007/0158071 A1 7/2007 Mooney, Jr. et al.
2008/0047456 A1 2/2008 Li et al.
2008/0110612 A1 5/2008 Prinz et al.
2008/0134922 A1 6/2008 Grattan et al.
2008/0149338 A1 6/2008 Goodman et al.
2008/0173204 A1 7/2008 Anderson et al.
2008/0173240 A1 7/2008 Furukawahara et al.
2008/0264639 A1 10/2008 Parrott et al.
2008/0314591 A1 12/2008 Hales et al.
2009/0050322 A1 2/2009 Hill et al.
2009/0056937 A1* 3/2009 Arumugam ..... E21B 23/04 166/85.1
2010/0000789 A1 1/2010 Barton et al.
2010/0065302 A1 3/2010 Nesbitt
2010/0089643 A1 4/2010 Vidal
2010/0096131 A1 4/2010 Hill et al.
2010/0163224 A1 7/2010 Strickland
2010/0230104 A1 9/2010 Nölke et al.
2010/0307773 A1 12/2010 Tinnen et al.
2011/0024116 A1 2/2011 McCann et al.
2012/0006217 A1 1/2012 Anderson
2012/0080202 A1 4/2012 Greenlee et al.
2012/0085538 A1 4/2012 Guerrero et al.
2012/0094553 A1 4/2012 Fujiwara et al.
2012/0199031 A1 8/2012 Lanclos
2012/0199352 A1 8/2012 Lanclos et al.
2012/0241169 A1 9/2012 Hales et al.
2012/0242135 A1 9/2012 Thomson et al.
2012/0247769 A1 10/2012 Schacherer et al.
2012/0247771 A1 10/2012 Black et al.
2012/0298361 A1 11/2012 Sampson
2013/0048376 A1 2/2013 Rodgers et al.
2013/0062055 A1 3/2013 Tolman et al.
2013/0112396 A1 5/2013 Splittstoeßer
2013/0118342 A1 5/2013 Tassaroli
2013/0168083 A1 7/2013 McCarter et al.
2013/0199843 A1 8/2013 Ross
2013/0248174 A1 9/2013 Dale et al.
2014/0008071 A1 1/2014 Patterson et al.
2014/0033939 A1 2/2014 Priess et al.
2014/0060839 A1 3/2014 Wang et al.
2014/0131035 A1 5/2014 Entchev et al.
2014/0148044 A1 5/2014 Balcer et al.
2014/0166370 A1 6/2014 Silva
2014/0209381 A1 7/2014 Huang et al.
2014/0318766 A1 10/2014 Bishop
2015/0176386 A1 6/2015 Castillo et al.
2015/0226533 A1 8/2015 Grattan
2015/0247375 A1 9/2015 Stout
2015/0330192 A1 11/2015 Rogman et al.
2015/0354310 A1 12/2015 Zaiser
2015/0356403 A1 12/2015 Storm, Jr.
2016/0040520 A1 2/2016 Tolman et al.
2016/0053560 A1 2/2016 Drury et al.
2016/0053561 A1 2/2016 Carr et al.
2016/0061572 A1 3/2016 Eitschberger et al.
2016/0069163 A1 3/2016 Tolman et al.
2016/0084048 A1 3/2016 Harrigan et al.
2016/0145990 A1 5/2016 Mace et al.
2016/0153271 A1 6/2016 Mace et al.
2016/0153272 A1 6/2016 Mace et al.
2016/0168961 A1 6/2016 Parks et al.
2016/0186511 A1 6/2016 Coronado et al.
2016/0186513 A1 6/2016 Robertson et al.
2016/0202033 A1 7/2016 Shahinpour et al.
2016/0258240 A1 9/2016 Fripp et al.
2016/0356132 A1 12/2016 Burmeister et al.
2017/0009560 A1 1/2017 Wells
2017/0030162 A1 2/2017 Carragher
2017/0030693 A1 2/2017 Preiss et al.
2017/0037716 A1 2/2017 Kohlik
2017/0044865 A1 2/2017 Sabins et al.
2017/0051586 A1 2/2017 Wells et al.
2017/0052011 A1 2/2017 Parks et al.
2017/0074078 A1 3/2017 Eitschberger
2017/0138150 A1 5/2017 Yencho
2017/0145798 A1 5/2017 Robey et al.
2017/0211363 A1 7/2017 Bradley et al.
2017/0226814 A1 8/2017 Clemens et al.
2017/0241244 A1 8/2017 Barker et al.
2017/0268860 A1 9/2017 Eitschberger
2017/0276465 A1 9/2017 Parks et al.
2017/0314372 A1 11/2017 Tolman et al.
2017/0314373 A9 11/2017 Bradley et al.
2017/0328134 A1 11/2017 Sampson et al.
2017/0328160 A1 11/2017 Arnaly
2017/0335646 A1 11/2017 Huang et al.
2018/0030334 A1 2/2018 Collier et al.
2018/0038208 A1 2/2018 Eitschberger et al.
2018/0080298 A1 3/2018 Covalt et al.
2018/0080300 A1 3/2018 Angstmann et al.
2018/0087330 A1 3/2018 Bradley et al.
2018/0106121 A1 4/2018 Griffin et al.
2018/0120066 A1 5/2018 Khatiwada et al.
2018/0127641 A1 5/2018 Nguyen et al.
2018/0135398 A1 5/2018 Entchev et al.
2018/0148995 A1 5/2018 Burky et al.
2018/0163497 A1 6/2018 Younger
2018/0171757 A1 6/2018 Xu
2018/0202248 A1 7/2018 Harrington et al.
2018/0202249 A1 7/2018 Harrington et al.
2018/0202790 A1 7/2018 Parks et al.
2018/0209251 A1 7/2018 Robey et al.
2018/0238132 A1 8/2018 Oag et al.
2018/0274342 A1 9/2018 Sites
2018/0274356 A1 9/2018 Hazel
2018/0283836 A1 10/2018 Thomas
2018/0299239 A1 10/2018 Eitschberger et al.
2018/0305993 A1 10/2018 Perkins et al.
2018/0306010 A1 10/2018 Von Kaenel et al.
2018/0318770 A1 11/2018 Eitschberger et al.
2018/0347324 A1 12/2018 Langford et al.
2018/0363424 A1 12/2018 Schroeder et al.
2019/0017356 A1 1/2019 Harrington et al.
2019/0040722 A1 2/2019 Yang et al.
2019/0048693 A1 2/2019 Henke et al.
2019/0049225 A1 2/2019 Eitschberger
2019/0106956 A1 4/2019 Wells
2019/0106962 A1 4/2019 Lee et al.
2019/0128657 A1 5/2019 Harrington et al.
2019/0136673 A1 5/2019 Sullivan et al.
2019/0162057 A1 5/2019 Montoya Ashton et al.
2019/0195054 A1 6/2019 Bradley et al.
2019/0211655 A1 7/2019 Bradley et al.
2019/0219375 A1 7/2019 Parks et al.
2019/0242222 A1 8/2019 Eitschberger
2019/0257181 A1 8/2019 Langford et al.
2019/0277103 A1 9/2019 Wells et al.
2019/0284889 A1 9/2019 LaGrange et al.
2019/0292887 A1 9/2019 Austin et al.
2019/0316449 A1 10/2019 Schultz et al.
2019/0330947 A1* 10/2019 Mulhern ..... E21B 23/14
2019/0338612 A1 11/2019 Holodnak et al.
2019/0366272 A1 12/2019 Eitschberger et al.
2019/0368293 A1* 12/2019 Covalt ..... E21B 33/128
2020/0018132 A1 1/2020 Ham
2020/0032602 A1 1/2020 Jennings et al.
2020/0032603 A1 1/2020 Covalt et al.

(56) References Cited

U.S. PATENT DOCUMENTS

| | | | |
|---|---|---|---|
| 2020/0032626 | A1 | 1/2020 | Parks et al. |
| 2020/0056442 | A1 | 2/2020 | Cherewyk et al. |
| 2020/0063537 | A1 | 2/2020 | Langford et al. |
| 2020/0095838 | A1 | 3/2020 | Baker |
| 2020/0199983 | A1 | 6/2020 | Preiss et al. |
| 2020/0248536 | A1 | 8/2020 | Holodnak et al. |
| 2020/0256156 | A1* | 8/2020 | Rosenthal ..... E21B 23/065 |
| 2020/0332630 | A1 | 10/2020 | Davis et al. |
| 2020/0362652 | A1* | 11/2020 | Eitschberger ..... E21B 23/06 |
| 2021/0048284 | A1 | 2/2021 | Maxted et al. |
| 2021/0123311 | A1* | 4/2021 | Rosenthal ..... E21B 23/0414 |
| 2021/0198964 | A1 | 7/2021 | Mulhern et al. |
| 2021/0215039 | A1* | 7/2021 | Scharf ..... E21B 23/04 |
| 2021/0355773 | A1 | 11/2021 | Eitschberger et al. |
| 2022/0074718 | A1 | 3/2022 | Mcnelis |

FOREIGN PATENT DOCUMENTS

| | | | |
|---|---|---|---|
| CA | 2271620 | A1 | 11/2000 |
| CA | 2821506 | A1 | 1/2015 |
| CA | 2824838 | A1 | 2/2015 |
| CA | 2941648 | A1 | 9/2015 |
| CA | 3040116 | A1 | 10/2016 |
| CA | 3022946 | A1 | 11/2017 |
| CA | 3021913 | A1 | 2/2018 |
| CA | 3050712 | A1 | 7/2018 |
| CA | 2980935 | C | 11/2019 |
| CA | 2848060 | C | 2/2021 |
| CN | 85107897 | A | 9/1986 |
| CN | 2821154 | | 9/2006 |
| CN | 2823549 | | 10/2006 |
| CN | 1284750 | C | 11/2006 |
| CN | 1965148 | A | 5/2007 |
| CN | 101397890 | A | 4/2009 |
| CN | 101435829 | A | 5/2009 |
| CN | 101454635 | A | 6/2009 |
| CN | 201620848 | U | 11/2010 |
| CN | 102278098 | B | 9/2013 |
| CN | 103485750 | A | 1/2014 |
| CN | 104499977 | A | 4/2015 |
| CN | 208870580 | U | 5/2019 |
| CN | 104481492 | B | 6/2019 |
| CN | 209195374 | U | 8/2019 |
| CN | 110424930 | A | 11/2019 |
| CN | 106522886 | B | 12/2019 |
| CN | 209908471 | U | 1/2020 |
| EP | 0088516 | A1 | 9/1983 |
| EP | 0385614 | A2 | 9/1990 |
| EP | 0216527 | B1 | 11/1990 |
| EP | 0180520 | B1 | 5/1991 |
| EP | 332287 | B1 | 7/1992 |
| EP | 679859 | A2 | 11/1995 |
| EP | 0482969 | B1 | 8/1996 |
| EP | 694157 | B1 | 8/2001 |
| EP | 2177866 | A1 | 4/2010 |
| EP | 2702349 | B1 | 11/2015 |
| EP | 3277913 | A1 | 2/2018 |
| EP | 3077612 | B1 | 5/2020 |
| GB | 2065750 | B | 6/1983 |
| GB | 2383236 | B | 1/2004 |
| GB | 2531450 | B | 2/2017 |
| GB | 2537749 | B | 3/2017 |
| GB | 2548203 | A | 9/2017 |
| RU | 2087693 | C1 | 8/1997 |
| RU | 2091567 | C1 | 9/1997 |
| RU | 2204706 | C1 | 5/2003 |
| RU | 30160 | U1 | 6/2003 |
| RU | 2211917 | C1 | 9/2003 |
| RU | 2221141 | C1 | 1/2004 |
| RU | 2224095 | C1 | 2/2004 |
| RU | 2295694 | C2 | 3/2007 |
| RU | 2312981 | C2 | 12/2007 |
| RU | 93521 | U1 | 4/2010 |
| RU | 98047 | U1 | 9/2010 |
| RU | 100552 | U1 | 12/2010 |
| RU | 2434122 | C2 | 11/2011 |
| RU | 2439312 | C1 | 1/2012 |
| RU | 2633904 | C1 | 10/2017 |
| WO | 1994009246 | A1 | 4/1994 |
| WO | 1994021882 | A1 | 9/1994 |
| WO | 9905390 | A1 | 2/1999 |
| WO | 2000020821 | A1 | 4/2000 |
| WO | 0049271 | A1 | 8/2000 |
| WO | 0159401 | A1 | 8/2001 |
| WO | 2001059401 | A1 | 8/2001 |
| WO | 2008066544 | A2 | 6/2008 |
| WO | 2009091422 | A3 | 3/2010 |
| WO | 2011160099 | A1 | 12/2011 |
| WO | 2012006357 | A2 | 1/2012 |
| WO | 2012006357 | A3 | 4/2012 |
| WO | 2012140102 | A1 | 10/2012 |
| WO | 2012106640 | A3 | 11/2012 |
| WO | 2012149584 | A1 | 11/2012 |
| WO | 2014046670 | A1 | 3/2014 |
| WO | 2014178725 | A1 | 11/2014 |
| WO | 2015006869 | A1 | 1/2015 |
| WO | 2015028204 | A2 | 3/2015 |
| WO | 2015134719 | A1 | 9/2015 |
| WO | 2016100064 | A1 | 6/2016 |
| WO | 2016100269 | A1 | 6/2016 |
| WO | 2016145420 | A1 | 9/2016 |
| WO | 2016161379 | A1 | 10/2016 |
| WO | 2017041772 | A1 | 3/2017 |
| WO | 2017125745 | A1 | 7/2017 |
| WO | 2017192878 | A1 | 11/2017 |
| WO | 2017199037 | A1 | 11/2017 |
| WO | 2018009223 | A1 | 1/2018 |
| WO | 2018136808 | A1 | 7/2018 |
| WO | 2018177733 | A1 | 10/2018 |
| WO | 2018213768 | A1 | 11/2018 |
| WO | 2019071027 | A1 | 4/2019 |
| WO | 2019148009 | A2 | 8/2019 |
| WO | 2019165286 | A1 | 8/2019 |
| WO | 2019180462 | A1 | 9/2019 |
| WO | 2019204137 | A1 | 10/2019 |
| WO | 2021013731 | A1 | 1/2021 |
| WO | 2021063920 | A1 | 4/2021 |

OTHER PUBLICATIONS

International Searching Authority; International Search Report and Written Opinion for PCT App. No. PCT/CA2014/050673; dated Oct. 9, 2014; 7 pages.

International Searching Authority; International Search Report and Written Opinion for PCT App. No. PCT/EP2015/059381; dated Nov. 23, 2015; 14 pages.

International Searching Authority; International Search Report and Written Opinion for PCT App. No. PCT/US2015/018906; dated Jul. 10, 2015; 12 pages.

International Searching Authority; International Search Report and Written Opinion of the International Searching Authority for PCT/EP2020/077180; dated Jan. 28, 2021; 13 pages.

Jet Research Center Inc., JRC Catalog, 2008, 36 pgs., https://www.jetresearch.com/content/dam/jrc/Documents/Books_Catalogs/06_Dets.pdf.

Jet Research Center Inc., Red RF Safe Detonators Brochure, 2008, 2 pages, www.jetresearch.com.

Jet Research Center, Plugs and Setting Tools, Alvarado, Texas, 13 pgs., https://www.jetresearch.com/content/dam/jrc/Documents/Books_Catalogs/02_Plugs_STNG_Tool.pdf.

Jet Research Center, Velocity™ Perforating System Plug and Play Guns for Pumpdown Operation, Ivarado, Texas, Jul. 2019, 8 pgs., https://www.jetresearch.com/content/dam/jrc/Documents/Brochures/jrc-velocity-perforating-system.pdf.

Jet Research Centers, Capsule Gun Perforating Systems, Alvarado, Texas, 27 pgs., Jun. 12, 2019 https://www.jetresearch.com/content/dam/jrc/Documents/Books_Catalogs/07_Cap_Gun.pdf.

McNelis et al.; High-Performance Plug-and-Perf Completions in Unconventional Wells; Society of Petroleum Engineers Annual Technical Conference and Exhibition; Sep. 28, 2015.

(56) References Cited

OTHER PUBLICATIONS

Norwegian Industrial Property Office, Office Action for NO Application No. 20061842, dated Dec. 21, 2014, 2 pages (Eng. Translation 2 pages).
Norwegian Industrial Property Office, Search Report for NO Application No. 20061842, dated Dec. 21, 2014, 2 pages.
Norwegian Industrial Property Office; Office Action and Search Report for NO App. No. 20160017; dated Jun. 15, 2017; 5 pages.
Norwegian Industrial Property Office; Office Action and Search Report for NO App. No. 20171759; dated Jan. 14, 2020; 6 pages.
Norwegian Industrial Property Office; Office Action for NO Appl. No. 20160017; dated Dec. 4, 2017; 2 pages.
Norwegian Industrial Property Office; Office Action for NO Appl. No. 20171759; dated Oct. 30, 2020; 2 pages.
Norwegian Industrial Property Office; Opinion for NO Appl. No. 20171759; dated Apr. 5, 2019; 1 page.
Owen Oil Tools & Pacific Scientific; RF-Safe Green Det, Side Block for Side Initiation, Jul. 26, 2017, 2 pgs.
Owens Oil Tools, E & B Select Fire Side Port Tandem Sub Assembly Man-30-XXX-0002-96, revised Dec. 2012, 9 pgs., https://www.corelab.com/owen/CMS/docs/Manuals/gunsys/MAN-30-XXX-0002-96-R00.pdf.
Parrot, Robert; Declaration, PGR 2020-00080; dated Aug. 11, 2020; 400 pages.
Patent Trial and Appeal Board; Decision Granting Patent Owner's Request for Rehearing and Motion to Amend for IPR2018-00600; dated Jul. 6, 2020; 27 pages.
PCT Search Report and Written Opinion, dated May 4, 2015: See Search Report and Written opinion for PCT Application No. PCT/EP2014/065752, 12 pgs.
Preiss Frank et al.; Lowering Total Cost of Operations Through Higher Perforating Efficiency while simultaneously enhancing safety; May 10, 2016; 26 pages.
Resilience Against Market Volatility Results Presentation; Exhibit 2015 of PGR No. 2020-00080; dated Jun. 30, 2020; 26 pages.
Robert Parrott, Case IPR2018-00600 for U.S. Pat. No. 9,581,422 B2, Declaration regarding Patent Invalidity, dated Jun. 29, 2020, 146 pages.
Rodgers, John; Declaration for PGR2020-00072; dated Oct. 23, 2020; 116 pages.
Rodgers, John; Declaration for PGR2020-00080; dated Nov. 18, 2020; 142 pages.
Salt Warren et al.; New Perforating Gun System Increases Safety and Efficiency; dated Apr. 1, 2016; 11 pages.
Scharf Thilo; Declaration for PGR2020-00080; dated Nov. 16, 2020; 16 pages.
Scharf, Thilo; Declaration for PGR2020-00072; dated Oct. 22, 2020; 13 pages.
Schlumberger & Said Abubakr, Combining and Customizing Technologies for Perforating Horizontal Wells in Algeria, Presented at 2011 MENAPS, Nov. 28-30, 2011, 20 pages.
Schlumberger, CPST Pressure Setting Tool, 2014, 1 pg., https://www.slb.com/-/media/files/co/product-sheet/cpst-pressure-setting-tool.
Schlumberger, Perforating Services Catalog, 2008, 521 pages.
Schlumberger; Selective Perforation: A Game Changer in Perforating Technology—Case Study; issued 2012; 14 pages.
Sharma, Gaurav; Hunting Plc Is Not in a Race to the Bottom, Says Oilfield Services Firm's CEO; dated Sep. 10, 2019; retrieved on Nov. 18, 2020; 6 pages.
SIPO, Search Report dated Mar. 29, 2017, in Chinese: See Search Report for CN App. No. 201480040456.9, 12 pgs. (English Translation 3 pgs.).
Smylie, Tom, New Safe and Secure Detonators for the Industry's consideration, presented at Explosives Safety & Security Conference, Marathon Oil Co, Houston; Feb. 23-24, 2005, 20 pages.
SPEX Group; SPEX Bridge Plugs & Setting Tools; Jan. 12, 2017; 3 pages.
State Intellectual Property Office People's Republic of China; First Office Action for Chinese App. No. 201811156092 7; dated Jun. 16, 2020; 6 pages (Eng Translation 8 pages).
State Intellectual Property Office, P.R. China; First Office Action for Chinese App No. 201580011132.7; dated Jun. 27, 2018; 5 pages (Eng. Translation 9 pages).
State Intellectual Property Office, P.R. China; First Office Action for CN App. No. 201480047092.7; dated Apr. 24, 2017.
State Intellectual Property Office, P.R. China; First Office Action with full translation for CN App. No. 201480040456.9; dated Mar. 29, 2017; 12 pages (English translation 17 pages).
State Intellectual Property Office, P.R. China; Notification to Grant Patent Right for Chinese App. No. 201580011132.7; dated Apr. 3, 2019; 2 pages (Eng. Translation 2 pages).
State Intellectual Property Office, P.R. China; Notification to Grant Patent Right for CN App. No. 201480040456.9; dated Jun. 12, 2018; 2 pages (English translation 2 pages).
State Intellectual Property Office, P.R. China; Second Office Action for CN App. No. 201480040456.9; dated Nov. 29, 2017; 5 pages (English translation 1 page).
State Intellectual Property Office, P.R. China; Second Office Action for CN App. No. 201480047092.7; dated Jan. 4, 2018; 3 pages.
Thilo Scharf; "DynaEnergetics exhibition and product briefing"; pp. 5-6; presented at 2014 Offshore Technology Conference; May 2014.
Thilo Scharf; "DynaStage & BTM Introduction"; pp. 4-5, 9; presented at 2014 Offshore Technology Conference; May 2014.
Thru-Tubing Systems, Series 1200—Auto Release Tool, 2003, 2 pgs., http://www.thrutubingsystems.com/intervention-products-and-services.php?product=/wireline-products/series-1200-auto-release-tool.
Thru-Tubing Systems, Thru-Tubing Systems Wireline Products Catalog, Apr. 25, 2016, 45 pgs., http://www.thrutubingsystems.com/phire-content/assets/files/Thru%20Tubing%20Syslems%20Wireline%20Producls.pdf.
Allied Horizontal Wireline Services, Addressable Disconnect Tool, Mar. 19, 2016, 3 pgs., http://alliedhorizontal.com/wireline-services/cased-hole-services/addressable-disconnect-tool/.
Amit Govil, Selective Perforation: A Game Changer in Perforating Technology—Case Study, presented at the 2012 European and West African Perforating Symposium, Schlumberger, Nov. 7-9, 2012, 14 pgs.
Austin Powder Company; A-140 F & Block, Detonator & Block Assembly; Jan. 5, 2017; 2 pgs.; https://www.austinpowder.com/wp-content/uploads/2019/01/OilStar_A140Fbk-2.pdf.
Baker Hughes, E-4 Wireline Pressure Setting Assembly and BHGE C Firing Heads, Mar. 8, 2018, 16 pages.
Baker Hughes, Long Gun Deployment Systems IPS-12-28; 2012 International Perforating Symposium; Apr. 26-27, 2011; 11 pages.
Baker Hughes; Power charge, Slow set, Size 10 E4; dated Sep. 18, 2020; https://www.shopbakerhughes.com/wireline/power-charge-slow-set-size-10-e4-h437660010.html; 4 pages.
Baker Hughes; Power charge, Standard, Size 20 E4; dated Sep. 20, 2020; https://www.shopbakerhughes.com/wireline/power-charge-standard-size-20-e4-h437643223.html; 4 pages.
Baker Hughes; SurePerf Rapid Select-Fire System Perforate production zones in a single run; 2012; 2 pages.
Brazilian Patent and Trademark Office; Search Report for BR Application No. BR112015033010-0; dated May 5, 2020; (4 pages).
Brico Oil Tools; BT Tool Inspection, Care and Maintenance Guideline; Setting Tool Inspection Information Product Family No. 41-21; dated Jan. 11, 2014; https://www.bricooiltools.com/pdfs/Brico-Setting-Tool-Inspection-manual.pdf.
Canadian Intellectual Property Office, Office Action of CA App. No. 3,040,648, dated Jun. 11, 2020, 4 pgs.
Canadian Intellectual Property Office; Notice of Allowance for CA Appl. No. 2,821,506; dated Jul. 31, 2019; 1 page.
Canadian Intellectual Property Office; Office Action for CA Appl. No. 2,821,506; dated Mar. 21, 2019; 4 pages.
Canadian Intellectual Property Office; Office Action for CA Application No. 3,040,648; dated Jul. 16, 2021; 3 pages.
Canadian Intellectual Property Office; Office Action for CA Application No. 3040648; dated Nov. 18, 2020; 4 pages.

(56) References Cited

OTHER PUBLICATIONS

Canatex, BRT Ballistic Release Tool, Dec. 13, 2017, 1 pg., https://daks2k3a4ib2z.cloudfront.net/59a43992f0b9de0001da166e/5a31b3b3fd7b9d00016b950a_CTX_BRT_CX17006.X02_13Dec2017.pdf.
Cao et al., Study on energy output efficiency of mild detonating fuse in cylindertube structure, Dec. 17, 2015, 11 pgs., https://www.sciencedirect.com/science/article/pii/S0264127515309345.
ControlFire User Manual; Exhibit No. 2005 of PGR No. 2020-00072; 2014; 56 pages.
Core Lab, Zero180™ Gun SystemAssembly and Arming Procedures—MAN-Z180-000 (RO7), Dec. 4, 2019, 33 pgs., https://www.corelab.com/owen/CMS/docs/Manuals/gunsys/zero180/MAN-Z180-000.pdf.
DynaEnergetics Europe GmbH; Patent Owner's Preliminary Response for PGR2020-00072; dated Oct. 23, 2020; 108 pages.
DynaEnergetics Europe GmbH; Patent Owner's Preliminary Response for PGR2020-00080; dated Nov. 18, 2020; 119 pages.
DynaEnergetics Europe GmbH; Principal and Response Brief of Cross-Appellant for United States Court of Appeals case No. 2020-2163, -2191; dated Jan. 11, 2021; 95 pages.
DynaEnergetics Europe; Exhibit B Invalidity Claim Chart for Civil Action No. 4:19-cv-01611; dated May 2, 2019; 52 pages.
DynaEnergetics Europe; Exhibit C Invalidity Claim Chart for Civil Action No. 4:17-cv-03784; dated Jul. 13, 2020; 114 pages.
DynaEnergetics Europe; Petition to Correct Inventorship in Patent under 37 C.F.R § 1.324; dated Oct. 13, 2020; 21 pages.
DynaEnergetics Europe; Plaintiffs' Local Patent Rule 3-1 Infringement Contentions for Civil Action No. 4:19-cv-01611; dated May 25, 2018; 10 Pages.
DynaEnergetics Europe; Plaintiffs' Preliminary Claim Constructions and Identification of Extrinsic Evidence Civil Action No. 4:17-cv-03784; dated Aug. 3, 2018; 9 pages.
DynaEnergetics Europe; Plaintiffs' Preliminary Infringement Contentions, Civil Action No. 6:20-cv-00069-ADA; dated Apr. 22, 2020; 32 pages.
DynaEnergetics Europe; Plaintiffs' Reply in Support of Motion to Dismiss and Strike for Civil Action No. 6:20-cv-00069-ADA; dated Apr. 29, 2020; 15 pages.
DynaEnergetics Europe; Plaintiffs Response to Defendant Hunting Titan Ins' Inoperative First Amended Answer, Affirmative Defenses, and Counterclaims for Civil Action No. 6:20-cv-00069-ADA; dated May 13, 2020.
DynaEnergetics Europe; Plaintiffs' Response to Defendants' Answer to Second Amended Complaint Civil Action No. 6:20-cv-00069-ADA; dated May 26, 2020; 18 pages.
DynaEnergetics exhibition and product briefing; Exhibit 2006 of PGR No. 2020-00072; dated 2013; 15 pages.
DynaEnergetics GmbH & Co. KG, Patent Owner's Response to Hunting Titan's Petition for Inter Parties Review—Case IPR2018-00600, filed Dec. 6, 2018, 73 pages.
DynaEnergetics GmbH & Co. KG; Patent Owner's Precedential Opinion Panel Request for Case IPR2018-00600; Sep. 18, 2019, 2 pg.
DynaEnergetics, DYNAselect Electronic Detonator 0015 SFDE RDX 1.4B, Product Information, Dec. 16, 2011, 1 pg.
DynaEnergetics, DYNAselect Electronic Detonator 0015 SFDE RDX 1.4S, Product Information, Dec. 16, 2011, 1 pg.
DynaEnergetics, DYNAselect Electronic Detonator 0015 TFSFDE RDX 1.4B, Product Information, Apr. 23, 2015, 1 pg.
DynaEnergetics, DYNAselect System, information downloaded from website, Jul. 3, 2013, 2 pages, http://www.dynaenergetics.com/.
DynaEnergetics, Electronic Top Fire Detonator, Product Information Sheet, Jul. 30, 2013, 1 pg.
DynaEnergetics, Selective Perforating Switch, information downloaded from website, Jul. 3, 2013, 2 pages, http://www.dynaenergetics.com/.
DynaEnergetics, Selective Perforating Switch, Product Information Sheet, May 27, 2011, 1 pg.
DynaEnergetics, Through Wire Grounded Bulkhead (DynaTWG). May 25, 2016, 1 pg., https://www. dynaenergetics.com/uploads/files/5756f884e289a_U233%20DynaTWG%20Bulkhead.pdf.
DynaEnergetics; DynaStage Solution—Factory Assembled Performance-Assured Perforating Systems; 6 pages.
DynaStage Gun System; Exhibit 2009 of PGR No. 2020-00080; dated May 2014; 2 pages.
EP Patent Office—International Searching Authority, PCT Search Report and Written Opinion for PCT Application No. PCT/EP2014/065752, dated May 4, 2015, 12 pgs.
Eric H. Findlay, Jury Trial Demand in Civil Action No. 6:20-cv-00069-ADA, dated Apr. 22, 2020, 32 pages.
European Patent Office; Invitation to Correct Deficiencies noted in the Written Opinion for European App. No. 15721178.0; dated Dec. 13, 2016; 2 pages.
European Patent Office; Office Action for EP App. No. 15721178.0; dated Sep. 6, 2018; 5 pages.
Federal Institute of Industrial Property; Decision of Granting for RU Appl. No. 2016104882/03(007851); dated May 17, 2018; 15 pages (English translation 4 pages).
Federal Institute of Industrial Property; Decision on Granting a Patent for Invention Russian App. No 2016139136/03(062394); dated Nov. 8, 2018; 20 pages (Eng Translation 4 pages); Concise Statement of Relevance: Search Report at 17-18 of Russian-language document lists several 'A' references based on RU application claims.
U.S. Patent Trial and Appeal Board, Institution of Inter Partes Review of U.S. Pat. No. 9581422, Case PR2018-00600,Aug. 21, 2018, 9 pages.
United States District Court for the Southern District of Texas Houston Division, Case 4:19-cv-01611 for U.S. Pat. No. 9,581,422B2, Plaintiff's Complaint and Exhibits, dated May 2, 2019, 26 pgs.
United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.
United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.
United States Patent and Trademark Office, Case IPR2018-00600 for U.S. Pat. No. 9,581,422 B2, Reply In Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.

(56) References Cited

OTHER PUBLICATIONS

United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of Patent No. 9,581,422, dated Mar. 7, 2019, 44 pgs.
United States Patent and Trademark Office, Final Office Action of U.S. Appl. No. 16/359,540, dated Aug. 14, 2019, 9 pages.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office, for U.S. Patent No. 10,429,161; 263 pages.
United States Patent and Trademark Office, for U.S. Pat. No. 10,472,938; 485 pages.
United States Patent and Trademark Office, Non-Final Office Action for U.S. Appl. No. 10/573,581, dated Nov. 14, 2008, 7 pages.
United States Patent and Trademark Office, Non-Final Office Action of U.S. Appl. No. 14/767,058, dated Jul. 15, 2016, 9 pages.
United States Patent and Trademark Office, Non-Final Office Action of U.S. Appl. No. 15/117,228, dated May 31, 2018, 9 pages.
United States Patent and Trademark Office, Non-Final Office Action of U.S. Appl. No. 15/617,344, dated Jan. 23, 2019, 5 pages.
United States Patent and Trademark Office, Non-Final Office Action of U.S. Appl. No. 15/788,367, dated Oct. 22, 2018, 6 pages.
United States Patent and Trademark Office, Non-Final Office Action of U.S. Appl. No. 15/920,800, dated Dec. 27, 2019, 6 pages.
United States Patent and Trademark Office, Non-Final Office Action of U.S. Appl. No. 15/920,812, dated Dec. 27, 2019, 6 pages.
United States Patent and Trademark Office, Non-Final Office Action of U.S. Appl. No. 15/920,812, dated May 27, 2020, 5 pages.
United States Patent and Trademark Office, Non-Final Office Action of U.S. Appl. No. 16/026,431, dated Jul. 30, 2019, 10 pages.
United States Patent and Trademark Office, Non-Final Office Action of U.S. Appl. No. 16/359,540, dated May 3, 2019, 11 pages.
United States Patent and Trademark Office, Notice of Allowance for U.S. Appl. No. 15/920,800, dated Jul. 7, 2020, 7 pages.
United States Patent and Trademark Office, Notice of Allowance for U.S. Appl. No. 16/585,790, dated Jun. 19, 2020, 16 pages.
United States Patent and Trademark Office, Office Action of U.S. Appl. No. 16/540,484, dated Oct. 4, 2019, 12 pgs.
United States Patent and Trademark Office, Office Action of U.S. Appl. No. 16/585,790, dated Nov. 12, 2019, 9 pgs.
United States Patent and Trademark Office, Office Action of U.S. Appl. No. 16/809,729, dated Jun. 19, 2020, 9 pgs.
United States Patent and Trademark Office, Office Action of U.S. Appl. No. 16/858,041, dated Jun. 16, 2020, 11 pgs.
United States Patent and Trademark Office, Office Action of U.S. Appl. No. 29/733,080, dated Jun. 26, 2020, 8 pgs.
United States Patent and Trademark Office, U.S. Appl. No. 61/733,129; filed Dec. 4, 2012; 10 pages.
United States Patent and Trademark Office, U.S. Appl. No. 61/819,196; filed May 3, 2013 ; 10 pages.
United States Patent and Trademark Office, U.S. Pat. No. 438,305A, issued on Oct. 14, 1890 to T.A. Edison, 2 pages.
United States Patent and Trademark Office; Final Office Action of U.S. Appl. No. 16/809,729, dated Nov. 3, 2020; 19 pages.
United States Patent and Trademark Office; Ex Parte Quayle Action for U.S. Appl. No. 17/381,701; dated Sep. 16, 2022; 8 pages.
United States Patent and Trademark Office; Final Office Action of U.S. Appl. No. 16/540,484; dated Mar. 30, 2020; 12 pgs.
United States Patent and Trademark Office; for U.S. Pat. No. 9,581,422 as of Aug. 23, 2017.
United States Patent and Trademark Office; Non Final Office Action for U.S. Appl. No. 16/886,257; dated Jan. 15, 2021; 7 pages.
United States Patent and Trademark Office; Non-Final Office Action for U.S. Appl. No. 16/379,341; dated Sep. 21, 2020; 15 pages.
United States Patent and Trademark Office; Non-Final Office Action for U.S. Appl. No. 17/201,093; dated Jun. 20, 2022; 14 pages.
United States Patent and Trademark Office; Non-Final Office Action for U.S. Appl. No. 17/210,093; dated Nov. 28, 2022; 7 pages.
United States Patent and Trademark Office; Notice of Allowance for U.S. Appl. No. 29/733,080; dated Oct. 20, 2020; 9 pages.
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU Application No. 2016110014/03(015803); issued Feb. 1, 2018; 6 pages (Eng. Translation 4 pages).
Gazda et al., A Battery-Operated, Electro-Mechanical Setting Tool for Use with Bridge Plugs and Similar Wellbore Tools, Jun. 1996, 7 pgs., https://onepetro.org/OTCONF/proceedings-abstract/95OTC/All-95OTC/OTC-7877-MS/44138.
GB Intellectual Property Office, Examination Report for GB App. No. GB1600085.3, dated Mar. 9, 2016, 1 pg.
GB Intellectual Property Office, Search Report for App. No. GB 1700625.5; dated Jul. 7, 2017; 5 pgs.
GB Intellectual Property Office; Examination Report for GB Appl. No. 1717516.7; dated Apr. 13, 2018; 3 pages.
GB Intellectual Property Office; Notification of Grant for GB Appl. No. 1600085.3; dated Jan. 24, 2017; 2 pages.
GB Intellectual Property Office; Notification of Grant for GB Appl. No. 1717516.7; dated Oct. 9, 2018; 2 pages.
GB Intellectual Property Office; Office Action for GB App. No. 1717516.7; dated Feb. 27, 2018; 6 pages.
GB Intellectual Property Office; Search Report for GB. Appl. No. 1700625.5; dated Dec. 21, 2017; 5 pages.
Ge Oil & Gas, Addressable Downhole Release Tools, Mar. 23, 2018, 5 pgs., https://www.bhge.com/upstream/evaluation/wireline-products-and-equipment/downhole-equipment/addressable-downhole-release-tools.
Ge Oil & Gas, Pipe Recovery Technology & Wireline Accessories, 2013, 435 pages.
German Patent Office, Office Action for German Patent Application No. 10 2013 109 227.6, which is in the same family as PCT Application No. PCT/EP2014/065752, see p. 5 for references cited, dated May 22, 2014, 8 pgs.
Gilliat et al.; New Select-Fire System: Improved Reliability and Safety in Select Fire Operations; 2012; 16 pgs.
Global Wireline Market; Exhibit 2010 of PGR 2020-00072; dated Oct. 15, 2019; 143 pages.
Gr Energy Services, ZipRelease Addressable Wireline Release Tool, Dec. 8, 2016, 2 pgs., https://grenergyservices.com/completion-services/perforating/addressable-wireline-release.
Halliburton, Releasable Cable Heads, 1 pg., Mar. 23, 2018, https://www.halliburton.com/en-US/ps/wireline-perforating/wireline-and-perforating/deployment-risk-avoidance/releasable-wireline-cable-head-rwch-tool.html.
Halliburton, Releasable Wireline Cable Head (RWCH Tool), 2016, 2 pgs., https://www.halliburton.com/content/dam/ps/public/lp/contents/Data_Sheets/web/H/Releasable-Wireline-Cable-Head-Tool-RWCH.pdf.
Halliburton; Wireline and Perforating Advances in Perforating; dated Nov. 2012; 12 pages.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Hunting Energy Service, ControlFire RF Safe ControlFire® RF-Safe Manual, 33 pgs., Jul. 2016, http://www.hunting-intl.com/media/2667160/ControlFire%20RF_Assembly%20Gun%20Loading_Manual.pdf.
Hunting Energy Services, Hunting T-Set Animation Web Video Screenshot, 2015, 1 page.
Hunting Titan Division, Marketing White Paper: H-1® Perforating Gun System, Jan. 2017, 5 pgs., http://www.hunting-intl.com/media/2674690/White%20Paper%20-%20H-1%20Perforating%20Gun%20Systems_January%202017.pdf.

(56) References Cited

OTHER PUBLICATIONS

Hunting Titan Inc.; Petition for Post Grant Review of U.S. Pat. No. 10,429,161; dated Jun. 30, 2020; 109 pages.
Hunting Titan Inc.; Petition for Post Grant Review of U.S. Pat. No. 10,472,938; dated Aug. 12, 2020; 198 pages.
Hunting Titan Ltd,; Defendants' Answer and Counterclaims, Civil Action No. 4:19-cv-01611, consolidated to Civil Action No. 4:17-cv-03784; dated May 28, 2019; 21 pages.
Hunting Titan Ltd.; Petition for Inter Partes Review of U.S. Pat. No. 9,581,422 Case No. IPR2018-00600; dated Feb. 16, 2018; 93 pages.
Hunting Titan Ltd.; Defendants' Answer and Counterclaims, Civil Action No. 6:20-cv-00069; dated Mar. 17, 2020; 30 pages.
Hunting Titan Ltd.; Defendants' Answer to First Amended Complaint and Counterclaims, Civil Action No. 6:20-cv-00069; dated Apr. 6, 2020; 30 pages.
Hunting Titan Ltd.; Defendants' Answer to Second Amended Complaint and Counterclaims, Civil Action No. 6:20-cv-00069; dated May 12, 2020; 81 pages.
Hunting Titan Ltd.; Defendants Invalidity Contentions Pursuant to Patent Rule 3-3, Civil Action No. 4:17-cv-03784; dated Jul. 6, 2018; 29 pages.
Hunting Titan Ltd.; Defendants' Objections and Responses to Plaintiffs' First Set of Interrogatories, Civil Action No. 4:17-cv-03784; dated Jun. 11, 2018.
Hunting Titan Ltd.; Defendants' Opposition to Plaintiffs' Motion to Dismiss and Strike Defendants' Amended Counterclaim and Affirmative Defenses for Unenforceability due to Inequitable Conduct for Civil Action No. 4:17-cv-03784; dated Apr. 24, 2018; 8 pages.
Hunting Titan, H-1 Perforating System, Sep. 1, 2017, 3 pgs., http://www.hunting-intl.com/titan/perforating-guns-and-setting-tools/h-1%C2%AE-perforating-system.
Hunting Titan, T-Set Setting Tool Product Catalog, 2015, 87 pgs., http://www.hunting-intl.com/media/1872254/AMG-1054.HT_T-Set_Catalog_LowRes.pdf.
Hunting Titan, Wireline Hardware, Logging Instruments EBFire, TCB Systems, Gun Systems, Oct. 15, 2015, V.9.1, 72 pgs., http://www.hunting-intl.com/media/1305595/hunting-titan-complete-v9-1.pdf.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Hunting Titan; Response to Canadian Office Action for CA App. No. 2,933,756; dated Nov. 23, 2017; 18 pages.
Hunting, T-Set® Family of Setting Tools, 2 pages.
Hunting, T-Set® Tool Catalog, Sep. 27, 2016, 87 pages.
Industrial Property Office, Czech Republic; Office Action for CZ App. No. PV 2017-675; dated Jul. 18, 2018; 2 pages; Concise Statement of Relevance: Examiner's objection of CZ application claims 1, 7, and 16 based on US Pub No. 20050194146 alone or in combination with WO Pub No. 2001059401.
Industrial Property Office, Czech Republic; Office Action for CZ App. No. PV 2017-675; dated Oct. 26, 2018; 2 pages.
Industrial Property Office, Czech Republic; Office Action; CZ App. No. PV 2017-675; dated Dec. 17, 2018; 2 pages.
INPI Argentina; Office Action for Application No. 20190101104; dated Sep. 6, 2022; 5 pages.
Instituto Nacional De La Propiedad Industrial; Office Action for AR Appl. No. 20140102653; dated May 9, 2019 (1 page).
Intellectual Property India, Office Action of IN Application No. 201647004496, dated Jun. 7, 2019, 6 pgs.
International Searching Authority, International Preliminary Report on Patentability for PCT App. No.PCT/ EP2014/065752; dated Mar. 1, 2016, 10 pgs.
International Searching Authority, International Search Report for International App No. PCT/EP2020/063214, dated Jul. 29, 2020, 17 pages.
International Searching Authority; Communication Relating to the Results of the Partial International Search for PCT/EP2020/070291; dated Oct. 20, 2020; 8 pages.
International Searching Authority; International Preliminary Report on Patentability for PCT Appl. No. PCT/CA2014/050673; dated Jan. 19, 2016; 5 pages.
United States Patent and Trademark Office; Notice of Allowance for U.S. Appl. No. 16/858,041; dated Oct. 22, 2020; 10 pages.
United States Patent and Trademark Office; Notice of Allowance for U.S. Appl. No. 15/920,812, dated Aug. 18, 2020; 5 pages.
United States Patent and Trademark Office; Notice of Allowance for U.S. Appl. No. 16/387,696; dated Jan. 29, 2020; 7 pages.
United States Patent and Trademark Office; Notice of Allowance for U.S. Appl. No. 14/904,788; dated Jul. 6, 2016; 8 pages.
United States Patent and Trademark Office; Notice of Allowance for U.S. Appl. No. 16/379,341; dated Jan. 19, 2021; 8 pages.
United States Patent and Trademark Office; Notice of Allowance for U.S. Appl. No. 16/585,790, dated Aug. 5, 2020; 15 pages.
United States Patent and Trademark Office; Notice of Allowance for U.S. Appl. No. 17/201,093; dated Dec. 27, 2022; 5 pages.
United States Patent and Trademark Office; Notice of Allowance for U.S. Appl. No. 17/381,701; dated Dec. 7, 2022; 5 pages.
United States Patent and Trademark Office; Office Action of U.S. Appl. No. 16/540,484, dated Aug. 20, 2020, 10 pgs.
United States Patent and Trademark Office; Restriction Requirement for U.S. Appl. No. 17/007,574; dated Oct. 23, 2020; 6 pages.
United States Patent and Trademark Office; Supplemental Notice of Allowability for U.S. Appl. No. 14/904,788; dated Jul. 21, 2016; 2 pages.
United States Patent and Trial Appeal Board; Final Written Decision on IPR2018-00600; dated Aug. 20, 2019; 31 pages.
United States Patent Trial and Appeal Board; Decision Denying Institution of Post-Grant Review; PGR No. 2020-00072; dated Jan. 19, 2021; 38 pages.
World Oil; DynaEnergetics expands DynaStage factory-assembled, well perforating systems; dated Mar. 14, 2017; 2 pages.

* cited by examiner

GAS DRIVEN WIRELINE RELEASE TOOL

CROSS-REFERENCE TO RELATED APPLICATIONS

This application claims the benefit of U.S. Provisional Patent Application No. 63/388,681 filed Jul. 13, 2022, the entire contents of which are incorporated herein by reference.

BACKGROUND OF THE DISCLOSURE

The wireline detonation release tool herein relates generally to the field of geological oil and gas production, more specifically to apparatus for use with wireline and e-line tools in exploration, logging, perforation operations, and more specifically to release tools used when downhole tool string becomes lodged in the well or in the casing or tubing within a wellbore. A detonation release tool is provided that enables the wireline cable to be easily released from the tool string upon activation of a detonation device housed within.

A most basic consideration in geological gas and oil exploration and production is the integrity of the well, wellbore or borehole. The stability of the wellbore can become compromised due to mechanical stress or chemical imbalance of the surrounding rock or other geological formation. Upon perforation, the geological structure surrounding the wellbore undergoes changes in tension, compression, and shear loads as the substrate, typically rock or sand, forming the core of the hole is removed. Chemical reactions can also occur with exposure to the surrounding substrate as well as to the drilling fluid or mud used in drilling operations. Under these conditions, the rock surrounding the wellbore can become unstable, begin to deform, fracture, and impinge into the wellbore.

As equipment such as logging tools, jet cutters, plug setting equipment or perforation guns are fed through the casing or tubing in the wellbore, debris, any deformity in the tool string itself and/or in its surroundings, bending, nonlinearity in the casing or tubing, fracture, stress or other unforeseen restrictions inside the well-tubulars can cause the equipment to become lodged or stuck in the wellbore, casing or tubing. This presents one of the biggest challenges to the oil and gas production industry. With gas and petroleum production costing tens to millions of dollars at each site of exploration or production, any complication or delay caused by lodged equipment results in additional human resource time, equipment cost and high expense to operations.

When tool string equipment becomes lodged or stuck, a decision is often made to temporarily or permanently leave the tool string section in the well. An attempt can be made later to fish-out, i.e., remove, the lodged equipment or the equipment can ultimately be abandoned in the well. This decision will depend upon factors such as suspected damage, difficulty of retrieving the equipment and safety concerns. Even when tool string equipment is left in the well, it is always desirable to attempt to recover the wireline cable that is connected to the lodged equipment for reuse in further geological operations, as wireline cable often contains intricate and valuable electrical equipment that is needed and reutilized repeatedly in exploration, service and well construction.

Release tools are employed in the industry to aid in release of stuck equipment and recovery of electrical wireline cable or slickline cable. Various types of release tools are available. Standard tension heads are conventionally used on wireline equipment to attach the wireline cable to the tool-string or perforation equipment. Tension-activated heads require a portion of the pulling force of the wireline cable to be used for mechanical separation of the cable from the drilling, perforation, or logging tool. Some release tools include a spring release assembly that can reengage with a fishing neck assembly. The logging tool string is retracted using a wireline or slickline, wherein during the retracting phase, a tapered surface on the logging tool string can force open latching jaws and allow the rest of the logging tool string to move through to be retrieved. As the distal end of the tool string has passed the closing arms of the springs, the opening arms return the latching jaws to the open position, resting against the inner bore of the subassembly.

Electrically activated wireline release systems are available that release the cable from the drilling or perforation tool by electrical activation in an effort to prevent the use of the tension full-safe load of the wireline cable which can cause damage to the electrical equipment on the wireline cable. Some release assembly systems use a surface controller operably associated with a downhole remote unit.

Hydraulically activated release tools are also available. Some hydraulic release tools include a connection between the housing carrying downhole equipment and the housing carrying the wireline cable. These housings are disconnected by a locking mechanism that is released by a slidable piston which is operated by fluid that is circulated through flow ports within the apparatus. Another cable release tool uses hydraulic time-delay technology with electrical wire tension to cause mechanical release of the wireline cable from the lodged equipment. Yet another release tool provides a mechanical release mechanism with three stages: an electrical feed-through commanded by a surface panel, a mechanical unlatch and hydrostatic pressure equalization and tool separation.

Detonation, explosive or ballistically activated release methods use a detonator to enable the wireline cable to disconnect from the lodged wireline tool string equipment. Some devices use a detonator, whereby, upon activation, a separation collar expands and actuates a shear ring to sever an equalizing plug inside the wireline release tool. The tool string is then released, allowing the wireline cable and any associated tool assemblies connected to the wireline cable to be removed from the well. Other devices may employ a similar mechanism designed to be used when a perforating gun system is comprised of addressable detonator switches with only a detonator in the device which receives a specific code supplying current to fire the detonator.

Despite the range of release tools currently available, the options remain limited in their release-enabling capacity in view of the tremendous size of the worldwide gas and oil industry and the myriad of challenges presented in operations. Current release tools, that are available on the market, may cause troubles by not reliable releasing of the tool string in horizontal zones of wells. Currently available release tools may also affect the feedthrough of the electrical signal and the electrical reliability of the perforating gun string.

Accordingly, there is a need for a wireline release tool that reliably releases the tool string in a horizontal zone of the well. There is a further need for a wireline release tool that is electrically reliable.

BRIEF DESCRIPTION OF THE EXEMPLARY EMBODIMENTS

According to an aspect, the exemplary embodiments include a wireline release tool which may have a casing having a longitudinally extending chamber, a first connector securely attached to the casing at a first end of the casing and configured for attachment to a wireline, a second connector disposed at a second end of the casing and configured for attachment to a tool string, and a gas generator disposed in the chamber between the first connector and the second connector. In some embodiments, the chamber may be enclosed and/or sealed within the casing between the first connector and the second connector. The second connector may, in some embodiments, be fixed to the casing by a shearable element. Upon shearing of the shearable element, the second connector may be slidable with respect to the casing between an initial position, in which the second connector closes the second end of the chamber, and a release position in which the second connector no longer closes the second end of the chamber. The gas generator may be capable of generating gas pressure in the chamber greater than an external pressure outside the wireline release tool within the well and may be sufficient to shear the shearable element and to force the second connector from the initial position to the release position.

In another aspect, the exemplary embodiments include a wireline release tool for use in a well, which may have an upper housing portion having a closed end, an open end, and a chamber therebetween; a lower housing portion disposed to close the open end of the first housing portion; and a gas generator disposed in the chamber between the closed end of the upper housing portion and the lower housing portion. In some embodiments, the lower housing portion may be shearably attached (e.g. by shearable element) to the open end of the upper housing portion and configured to close the open end. Upon shearing of the attachment, the lower housing portion may be slidable with respect to the upper housing portion between an initial position in which the lower housing portion closes the open end of the chamber and a release position in which the lower housing portion no longer closes the open end of the chamber. The gas generator may be capable of generating gas pressure in the chamber greater than an external wellbore pressure and which may be sufficient to shear the shearable attachment and to force the lower housing portion from the initial position to the release position.

In a further aspect, the exemplary embodiments include a wireline release tool, which may include a casing having a longitudinally extending chamber, a first connector securely attached to the casing at a first end and configured for attachment to a wireline, a second connector disposed at a second end of the casing and configured for attachment to a tool string, and a gas generator disposed in the chamber between the first connector and the second connector. The chamber may be enclosed within the casing between the first connector and the second connector, and the second connector may be fixed to the casing by a shearable element. Upon shearing of the shearable element, the second connector may be slidable with respect to the casing between an initial position, in which the second connector closes the second end of the chamber, and a release position in which the second connector no longer closes the second end of the chamber. In some embodiments, the casing may further comprise one or more dampening ports extending from the chamber through an outer wall of the housing. In some embodiments, the one or more dampening ports may be angled away from the second connector. The second connector may include one or more seal elements configured so that, in the initial position, the one or more seal elements prevent fluid communication between the chamber and an external wellbore environment via the one or more dampening ports, and in a venting position disposed between the initial position and the release position, the one or more seal elements allow fluid communication between the chamber and the external wellbore environment so that gas pressure from the gas generator may exit the chamber through the dampening ports.

In yet a further aspect, wireline release tool embodiments may include a first housing portion and a second housing portion, which together may jointly form an enclosed housing having a chamber enclosed therein. The first housing portion may have a closed end, an open end, and the chamber therebetween, and the second housing portion may be shearably attached (e.g. by shearable element) to close the open end of the first housing portion (thereby enclosing the chamber). A gas generator may be disposed in the chamber. In some embodiments, the gas generator may be capable of generating gas pressure in the chamber sufficient to overcome a pressure differential between the chamber and the external wellbore environment, and to force the second housing portion from an initial position to a release position.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
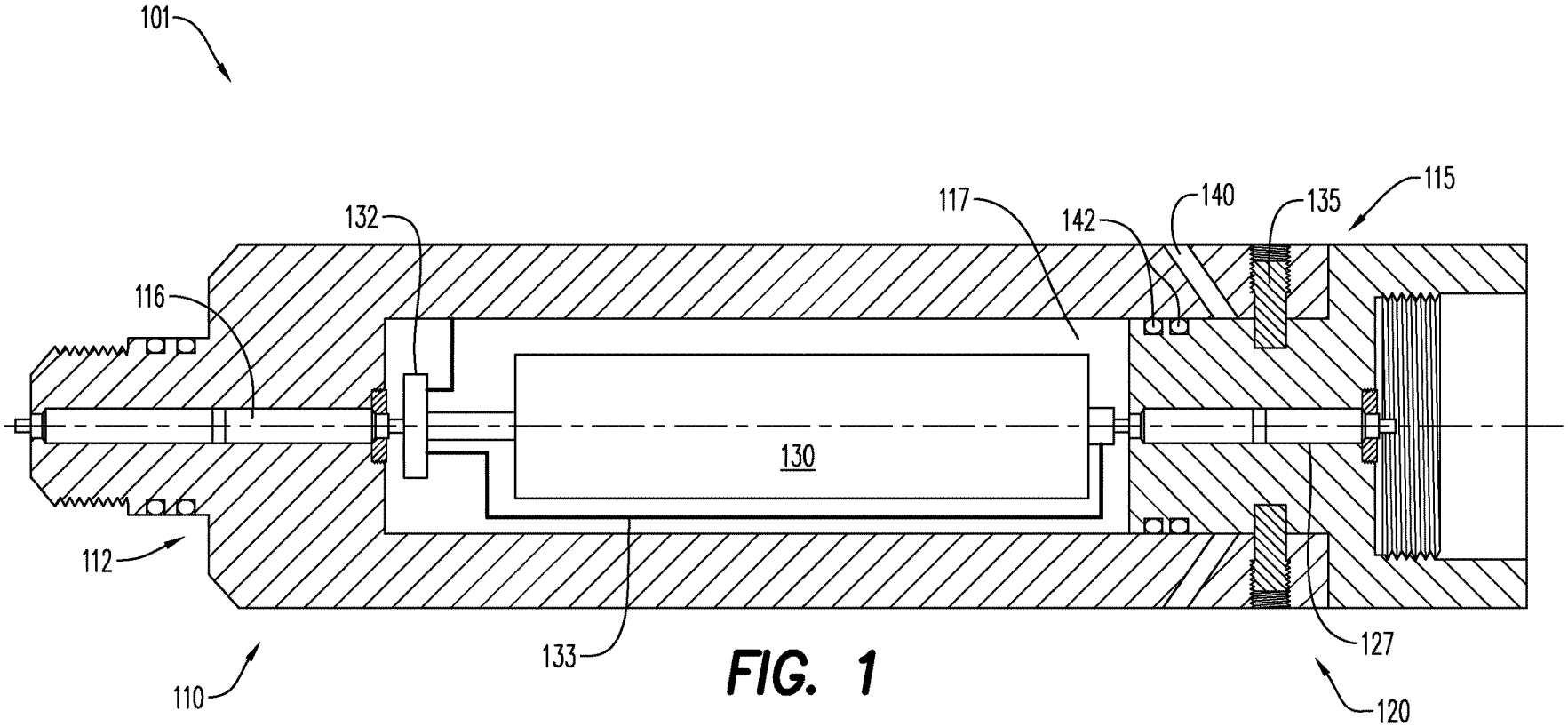
FIG. 1 is a cross-sectional view of an exemplary wireline release tool, according to an embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment".

As used herein and for the purposes of this disclosure, the term "downhole" or "downwell" refers to the direction going into the well away from the earth's surface during a well operation. Conversely, the term "uphole" or "upwell" refers to the direction going upward toward the earth's surface, out of the well, and/or opposite of downhole or downwell. Consistent therewith, the term "downward" and the like are used herein to indicate the direction of the release tool herein that is directed in the downhole direction; and the term "upward" and the like are used herein to indicate an uphole direction in the well.

As used herein and for the purposes of this disclosure, the term "wireline" is used interchangeably and intended to incorporate the term wireline cable. In typical well operations, a wireline cable conveys equipment such as logging equipment for collecting data like temperature and pressure and for measuring other well parameters; cameras for optical observation; equipment for performing radioactive irradiation; logging equipment for performing evaluation of localized geological strata; electrical equipment for conveying electrical signals and information from the surface to the downhole tool string to which the wireline is connected; and other tools used in well operations. As used herein, wireline also includes electric line, e-line or slickline, whereby a single strand is used in a well operation. In alternate embodiments, coiled tubing with an electrical feedthrough, commonly known as E-coil, as well as a coiled tubing without an electrical conductor, are operable with the release tool herein. According to other embodiments, it will be further understood by persons skilled in the art that other cables that are used to introduce and deliver tools downhole are operable with the release tool herein.

As used herein and for the purposes of this disclosure, the term "tool string" refers to equipment such as logging equipment, perforation guns, jet cutters, fracturing tools, acidizing tools, cementing tools, production enhancement tools, completion tools or any other tool capable of being coupled to a downhole string for performing a downhole well operation.

For purposes of this disclosure, the phrases "devices," "systems," and "methods" may be used either individually or in any combination referring without limitation to disclosed components, grouping, arrangements, steps, functions, or processes.

Exemplary wireline release tool embodiments may include a first housing portion and a second housing portion, which together may jointly form an enclosed housing having a chamber enclosed therein. The first housing portion may have a closed end, an open end, and the chamber therebetween, and the second housing portion may be shearably attached (e.g. by shearable element) to close the open end of the first housing portion (thereby enclosing the chamber). A gas generator may be disposed in the chamber. In some embodiments, the gas generator may be capable of generating gas pressure in the chamber sufficient to overcome a pressure differential between the chamber and the external wellbore environment and to force the second housing portion from an initial position to a release position (including shearing of the shearable attachment). In some embodiments, an activator, which may be configured to activate the gas generator, may also be disposed in the chamber. One of the housing portions may be configured for attachment to a wireline, while the other of the housing portions may be configured for attachment to a tool string. The wireline release tool may be configured so that, upon receiving an activation signal, the activator activates the gas generator, which generates gas until the pressure is sufficient to separate the first and second housing portion, thereby releasing the wireline from the tool string.

In some embodiments, the housing may include one or more dampening ports extending from the chamber through an outer wall of the housing. For example, the dampening ports may extend through the wall of the first housing portion. The dampening ports may be configured to dampen recoil during separation of the second housing portion from the first housing portion. For example, the one or more dampening ports may be configured to be angled uphole and/or away from the second housing portion. The wireline release tool may also include one or more seals configured so that, in the initial position, the one or more seals prevent fluid communication between the chamber and an external wellbore environment via the one or more dampening ports, and in a venting position located between the initial position and the release position, the one or more seals allow fluid communication between the chamber and the external wellbore environment so that some of the gas pressure from the gas generator may exit the chamber through the dampening ports.

The activator may be configured to activate the gas generator in response to receiving an activation signal from the surface via the wireline. In some embodiments, before activation of the gas generator, the pressure inside the wireline release tool (e.g. in the chamber) may be less than an external wellbore pressure, and there may be no pressure equalization between the chamber and the external wellbore environment before activation of the gas generator. In some embodiments, the first housing portion may include a casing, with two open ends and the chamber therebetween, and a first connector securely attached to one of the open ends (e.g. to form the closed end of the first housing portion). In some embodiments, the second housing portion may include a second connector. In some embodiments, the first connector and the second connector may each include a bulkhead therethrough (e.g. which may include seals to maintain the sealing ability of the connectors), and the tool may also have an electrical signal feedthrough (e.g. in the chamber and/or providing electrical communication between the two bulkheads). In some embodiments, the first housing portion may be configured to be disposed uphole of the second housing portion, the first housing portion may be configured for attachment to a wireline, and the second housing portion may be configured for attachment to a tool string. In other embodiments, the first housing portion may be configured to be disposed downhole of the second housing portion, the second housing portion may be configured for attachment to a wireline, and the first housing portion may be configured for attachment to a tool string.

Exemplary embodiments will now be introduced according to FIGS. 1-7. The exemplary embodiments according to FIGS. 1-7 are illustrative and not limiting, and exemplary features may be referenced throughout this disclosure. The disclosure describes wireline release tool embodiments that may enable the release of a part of a wireline perforating gun string in a controlled manner.

Turning now to FIG. 1, an exemplary wireline release tool 101 for use in a well/wellbore is disclosed. The wireline release tool 101 of FIG. 1 includes an upper housing portion 110 having a closed end 112, an open end 115 (e.g. opposite the closed end 112), and a chamber 117 (which may be longitudinal) therebetween. The wireline release tool 101 further includes a lower housing portion 120 disposed to close the open end 115 of the upper housing portion 110, and a gas generator 130 disposed in the chamber 117 between the closed end 112 of the upper housing portion 110 and the lower housing portion 120. In FIG. 1, the lower housing portion 120 is shearably attached to the open end 115 of the upper housing portion 110 and configured to close/seal the open end 115, thereby forming a housing with an enclosed/sealed chamber 117 (e.g. with the housing as a whole being formed of the upper housing portion 110 and the lower housing portion 120 being coupled together by shearable attachment). For example, one or more shearable element 135 may shearably attach the lower housing portion 120 to the open end 115 of the upper housing portion 110. In some embodiments, the one or more shearable element 135 may include one or more shear pins, one or more shear screws, one or more shear bolts, one or more shear rings, and the like. Upon shearing of the attachment, the lower housing portion 120 is slidable with respect to the upper housing portion 110 between an initial position (e.g. as shown in FIGS. 1, 2, 3, 4, 5*a*, and 6), in which the lower housing portion 120 closes/seals the open end 115 of the chamber 117, and a release position (e.g. as shown in FIG. 5*d*) in which the lower housing portion 120 no longer closes/seals the open end 115 of the chamber 117.

In some embodiments, the gas generator 130 is capable of generating (e.g. configured to generate) gas pressure in the chamber 117 greater than an external wellbore pressure and which is sufficient to shear the shearable attachment (e.g. the shearable element 135) and to force the lower housing portion 120 from the initial position to the release position. In some embodiments, before activation of the gas generator 130, there may be a pressure differential between the chamber 117 and the external wellbore environment. For example, before activation of the gas generator 130, the external wellbore environment may have a higher pressure than the chamber 117 and/or the pressure inside the wireline release tool 101 may be less than the external wellbore pressure (e.g. when the tool is disposed in the well). The gas pressure generated within the chamber 117 may be sufficient to overcome the pressure differential between the chamber 117 and an external wellbore environment, in addition to shearing the shearable attachment (e.g. the shearable element 135) and moving the lower housing portion 120 from the initial position to the release position.

In FIG. 1, the shearable element 135 may be configured to attach the lower housing portion 120 to the upper housing portion 110 (e.g. to close/seal the open end 115 of the upper housing portion 110), and may span between the external surface of the lower housing portion 120 and the interior surface of the upper housing portion 110 (e.g. forming an interference lock that prevents sliding of the lower housing portion 120 with respect to the upper housing portion 110 until such time as the one or more shearable elements 135 are sheared). For example, there may be corresponding cavities in each of the upper housing portion 110 and the lower housing portion 120 which are configured to hold the shearable element 135 (e.g. with opposite ends of the shearable element 135 disposed in the corresponding cavities) in the initial position. In some embodiments, the shearable element may be coupled to the upper and lower housing, for example by being disposed in the corresponding cavities therein to form the shearable interference lock. The gas generator 130 may provide sufficient pressure (e.g. pressing on the lower housing portion 120) to shear the shearable element 135 and drive the lower housing portion 120 from the initial position towards the release position. In some embodiments, when the lower housing portion 120 and the upper housing portion 110 are no longer in contact (e.g. in the release position), the sheared portions of the shearable element 135 may be free to exit (e.g. fall out of) the corresponding cavities.

In some embodiments, as shown for example in FIG. 1, the housing may further comprise one or more dampening ports 140 extending from the chamber 117 through an outer wall of the housing. For example, the one or more dampening ports 140 may include vents or channels which extend outwardly from the chamber 117 through the outer wall of the upper housing portion 110 (e.g. to the exterior surface of the housing, for example providing fluid communication between the chamber 117 and the external wellbore environment). In some embodiments, each of the dampening ports 140 may have a uniform width or diameter. For example, the width/diameter of each of the one or more dampening ports 140 in some embodiments may range from approximately 0.04 to 1.0 inch or from approximately 0.1 to 1.0 inch (for example 0.1 inch to 0.2 inch). In some embodiments having a plurality of dampening ports 140, all of the plurality of dampening ports 140 may be uniform (e.g. be substantially identical). Some exemplary embodiments of the housing may have a plurality of dampening ports 140, for example ranging from 2 to 180 ports, from 2 to 20 ports, from 4 to 12 ports, or from 6 to 10 dampening ports 140, which may be disposed in some embodiments circumferentially around the housing. In some embodiments, the plurality of dampening ports 140 may be evenly spaced around the circumference of the housing. In some embodiments, all of the plurality of dampening ports 140 may be located in a single plane, which may be perpendicular to the longitudinal axis of the wireline release tool 101. The one or more dampening ports 140 may be configured to dampen recoil during separation of the lower housing portion 120 from the upper housing portion 110 (e.g. at the release position). For example, the one or more dampening ports 140 may be angled uphole (e.g. to vent away from the lower housing portion 120 and/or tool string). In various embodiments, the one or more dampening ports 140 may be angled uphole at an angle ranging from approximately 20 to 70 degrees, from approximately 30 to 60 degrees, from approximately 30 to 45 degrees, or from approximately 40 to 60 degrees (e.g. measured from the longitudinal axis of the wireline release tool 101). In some embodiments, all of the dampening ports may be angled identically.

Embodiments may further comprise one or more seals 142, which may be configured to seal the chamber 117 at the interface between the upper housing portion 110 and the lower housing portion 120. In some embodiments, the lower housing portion 120 may comprise the one or more seals 142 140 (e.g. the one or more seals 142 may be attached/mounted on the lower housing portion 120, for example on its exterior surface). In other embodiments, the one or more seals 142 may be mounted to the upper housing portion 110 (e.g. on the interior surface of the chamber/upper housing portion) or to both the upper and lower housing portions.

The one or more seals 142 may be configured so that, in the initial position of the lower housing portion 120, the one or more seals 142 prevent fluid communication between the chamber 117 and an external wellbore environment via the one or more dampening ports 140 (e.g. being positioned between the chamber 117 and the one or more dampening ports 140). See for example, FIGS. 1-4, 5*a*, and 6. In FIG.

1, the one or more seals 142 may be disposed on the exterior surface of the upper end of the lower housing portion 120, which may be configured to fit (e.g. slidingly) within the open end 115 of the upper housing portion 110 to close the open end 115. The one or more seals 142 may be configured to seal the interface between the upper end of the lower housing portion 120 and the inner surface of the upper housing portion 110 (e.g. being disposed between the exterior surface of the lower housing portion 120 and the inner surface of the upper housing portion 110). In a venting position of the lower housing portion 120 (see for example, FIG. 5C), located between the initial position and the release position, the one or more seals 142 may allow fluid communication between the chamber 117 and the external wellbore environment so that gas pressure from the gas generator 130 may exit the chamber 117 through the one or more dampening ports 140 (e.g. being positioned below the one or more dampening ports 140, so that there is no barrier to fluid communication located between the chamber 117 and the one or more dampening ports 140). For example, the tool may be configured to vent gas from the chamber 117 when the lower housing portion 120 moves/is disposed between the venting position (e.g. when the seals 142 are disposed below the interior vent openings of the one or more dampening ports 140 in the outer wall of the upper housing portion 110) and the release position (e.g. when the lower housing portion 120 separates from the open end 115 of the upper housing portion 110).

In some embodiments, the lower housing portion 120 may be configured for attachment to a tool string, for example at its lower end, while the upper housing portion 110 may be configured for attachment to a wireline, for example at its upper end. For example, as shown in FIG. 1, exterior threads on the upper end of the upper housing portion 110 may be configured for mating connection with a wireline. Interior threads on the lower end of the lower housing portion 120 may be configured for mating connection with a tool string (e.g. via TSA or sub in some embodiments). In some embodiments, the upper end of the upper housing portion 110 may be configured to extend uphole with a smaller diameter than the main portion of the upper housing portion 110, and this upper end extension may be configured for attachment to the wireline. In some embodiments, a first bulkhead 116 may extend through the closed end 112 and/or upper end of the upper housing, and the first bulkhead 116 may be configured for electrical passthrough/communication from the wireline to the chamber 117. In some embodiments, the upper end of the lower housing portion 120 may be configured to slidingly interface with (e.g. fit within) the open end 115 of the upper housing portion 110. For example, the upper end of the lower housing portion 120 may have a diameter that is approximately the same as the diameter of the chamber 117 of the upper housing portion 110. The lower end of the lower housing portion 120 may be configured for attachment to the tool string (e.g. attachment to a TSA or to a sub or directly to a tool). The lower housing portion 120 may include a second bulkhead 127, which may be configured to extend through the upper end of the lower housing portion 120 and which may be configured for electrical passthrough from the chamber 117 to the tool string attached below the lower housing portion 120.

In some embodiments, the wireline release tool 101 may further include an activator (such as the igniter 132 of FIG. 1) configured to activate the gas generator 130 in response to receiving an activation signal from the surface via the wireline wherein. For example, the activator may be disposed in the chamber 117 of the housing. Before activation of the gas generator 130, the pressure inside the wireline release tool 101 (e.g. in the chamber 117) may be less than the external wellbore pressure. The wireline release tool 101 may be configured so that there is no pressure equalization between the chamber 117 and the external wellbore pressure before activation of the gas generator 130. For example, there may be no fluid communication between the chamber and the external wellbore environment before activation of the gas generator 130. After activation of the gas generator 130, the pressure inside the wireline release tool 101 (e.g. within the chamber 117) may rise to be greater than the external pressure. For example, the pressure in the chamber 117 after activation of the gas generator 130 (but before the lower housing portion 120 moves to either the venting position or the release position—while the chamber is still sealed) may be sufficient to overcome the shearing attachment (e.g. sufficient to shear the shearing element), overcome the external pressure in the wellbore, and/or push the lower housing portion 120 to the release position (e.g. downhole). In some embodiments, the gas pressure from the gas generator 130 may provide the only force acting to separate the upper and lower housing portions (e.g. to move the lower housing portion 120 from the initial position to the vent position and/or the release position). In some embodiments, the activator may be an igniter 132, as shown in FIG. 1 for example, which may be ballistically coupled to the gas generator 130 (e.g. a power charge 130, as shown in FIG. 1).

In some embodiments, the wireline release tool 101 may further include an electrical signal feedthrough 133 configured to pass an electrical signal from the surface via the wireline through the wireline release tool 101 (e.g. to the tool string below). For example, the electrical signal feedthrough 133 may provide electrical communication between the first bulkhead 116 and the second bulkhead 127. In some embodiments, the electrical signal feedthrough 133 may provide electrical communication between the activator and the second bulkhead 127. The signal that is passed through may be configured to operate one or more tool in the tool string, for example.

Different wireline release tool 101 embodiments may use different types of gas generators. For example, in FIG. 1, the gas generator 130 may be a power charge (such as power charge 330 for FIG. 3A). For example, activation of a chemical reaction in the power charge 330 may result in a substantial force (e.g. from expanding gas generated by the chemical reaction) being exerted within the chamber. Initiation of the chemical reaction, e.g., combustion, may begin at a section of power charge 330 remote from lower housing portion 120 and the chemical reaction may proceed in a direction toward the lower housing portion 120. The substantial force exerted by the power charge 330 within the chamber can also shear one or more shearable elements or similar frangible members that serve certain functions, e.g., holding the two portions of the housing together in place prior to activation. In some embodiments, the force applied to a tool by the power charge should be controlled; it should be sufficient to actuate the tool reliably but not so excessive as to damage the downhole tools or the wellbore itself. Also, even a very strong force may fail to properly actuate a tool if delivered too abruptly or over too short a time duration. Even if a strong force over a short time duration will actuate a tool, such a set-up may not be ideal in some embodiments. That is, a power charge configured to provide force over a period of a few seconds or tens of seconds instead of a few milliseconds is sometimes required and/or may be the desired option. Depending on the particular function of a given tool and other parameters, favorable force characteristics may be provided by a force achieving work over a period of milliseconds, several seconds or even longer. In some exemplary embodiments, the power charge may have a load of approximately 300 g (+/−50 g) of solid combustible material and/or may be configured to produce a pressure in the chamber in excess of 60,000 pounds and/or may produce a breaking force of up to 200,000 pounds (e.g. approximately 180,000 pounds). Additional details regarding exemplary power charge embodiments may be of the type described in U.S. patent application Ser. No. 17/524,837 filed Nov. 12, 2021, which is commonly owned by DynaEnergetics Europe GmbH and incorporated herein by reference in its entirety to the extent that it is not inconsistent with the explicit disclosure herein. The power charge may be oriented to discharge towards the lower housing portion 120 (e.g. downhole). Also, depending on the type of gas generator 130, different types of activators may be used. For example, in FIG. 1, an igniter 132 may be used to activate the power charge 330. The igniter 132 may be electrically coupled to the first bulkhead 116, and may be electrically coupled to the electrical signal feedthrough 133. The igniter 132 may also be grounded, for example with a ground wire electrically coupling the igniter 132 to the outer wall of the upper housing portion 110. In some embodiments, the igniter 132 may be an electrical igniter. In some embodiments, the igniter 132 may be ballistically coupled to the power charge 330.

The wireline release tool 101 illustrated in FIG. 2 may be substantially similar to the wireline release tool 101 illustrated in FIG. 1 and describe hereinabove. Thus, for purposes of convenience and not limitation, the features of FIG. 2 that are similar to FIG. 1 are not described in detail hereinbelow. In the exemplary embodiment of FIG. 2, the gas generator 130 may be a gas container holding gas under pressure, and the activator may be configured to open the gas container in response to receiving the activation signal. For example, the activator may include a valve. In some embodiments, the valve may be an electrically operated valve, such as a solenoid valve. In some embodiments, the activator may also include a switch. For example, the switch may determine whether the electrical signal from the surface is transmitted to the tool string via the feedthrough 133 or whether the electrical signal proceeds to activate the gas generator 130 (e.g. by activating the valve or activating the igniter). In some embodiments, the gas within the gas container may be an inert gas, such as Nitrogen.

In some embodiments, the shearable element 135 may form the only structural connection between the upper housing portion 110 and the lower housing portion 120 (e.g. between the first housing portion and the second housing portion). In some embodiments, the gas pressure in the chamber 117 may provide the only force within the tool moving the lower housing portion 120 (e.g. second housing portion or second connector 320) from the initial position to the release position. In some embodiments, the shearable element 135 may be configured to support the full weight of the tool string (plus expected pulling tensile force on the wireline in some embodiments), and may be configured to only shear at greater tensile forces. In some embodiments, the shearable element 135 may be configured to shear only when tensile force applied to the wireline release tool 101 is in excess of the tensile strength of the wireline. For example, the tool 101 may be stronger than the wireline. In some embodiments, the shear strength of the shearable element 135 may range from 5,000 lbs to 30,000 lbs. In some embodiments, the shearable element 135 may include a plurality of shear screws, pins, etc., for example 2-12 shear screws, 4-10 shear screws, 6-10 shear screws, or 8 shear screws. For example, in embodiments having 8 shear screws, the breaking force may range from 1000N to 800,000 N or from approximately 86,000 N to approximately 165,000 N. In some embodiments, the gas generator 130 may generate gas sufficient to provide a pressure in the chamber 117 that, when acting on the lower housing portion 120/second housing portion, may shear the shearable element 135. In some embodiments, the pressure generated by the gas generator 130 in the chamber 117 may generate a pushing force on the lower housing portion 120 (e.g. second housing portion) greater than the tensile strength of the wireline.

Figure 3A:
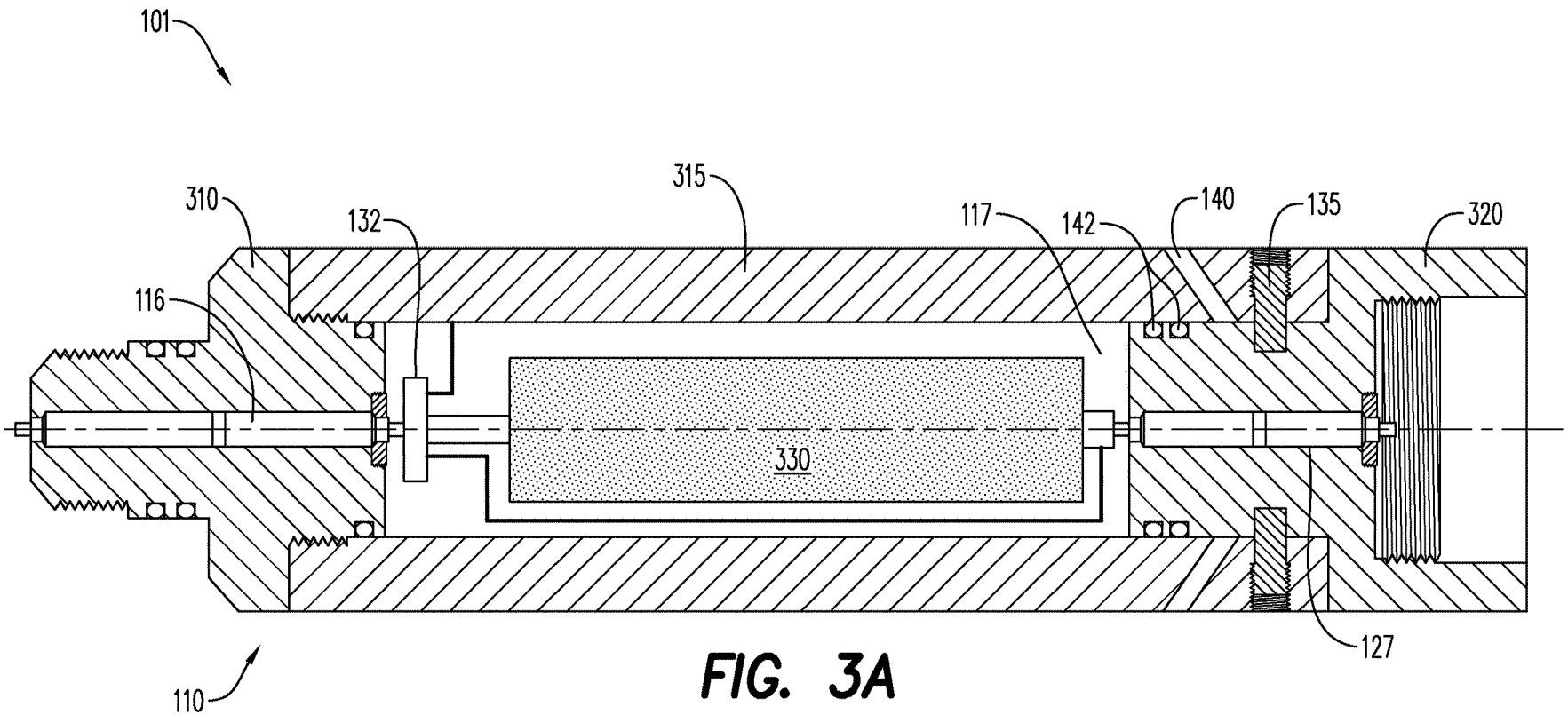
FIG. 3A is a cross-sectional view of yet another exemplary wireline release tool, according to an embodiment.
Figure 4:
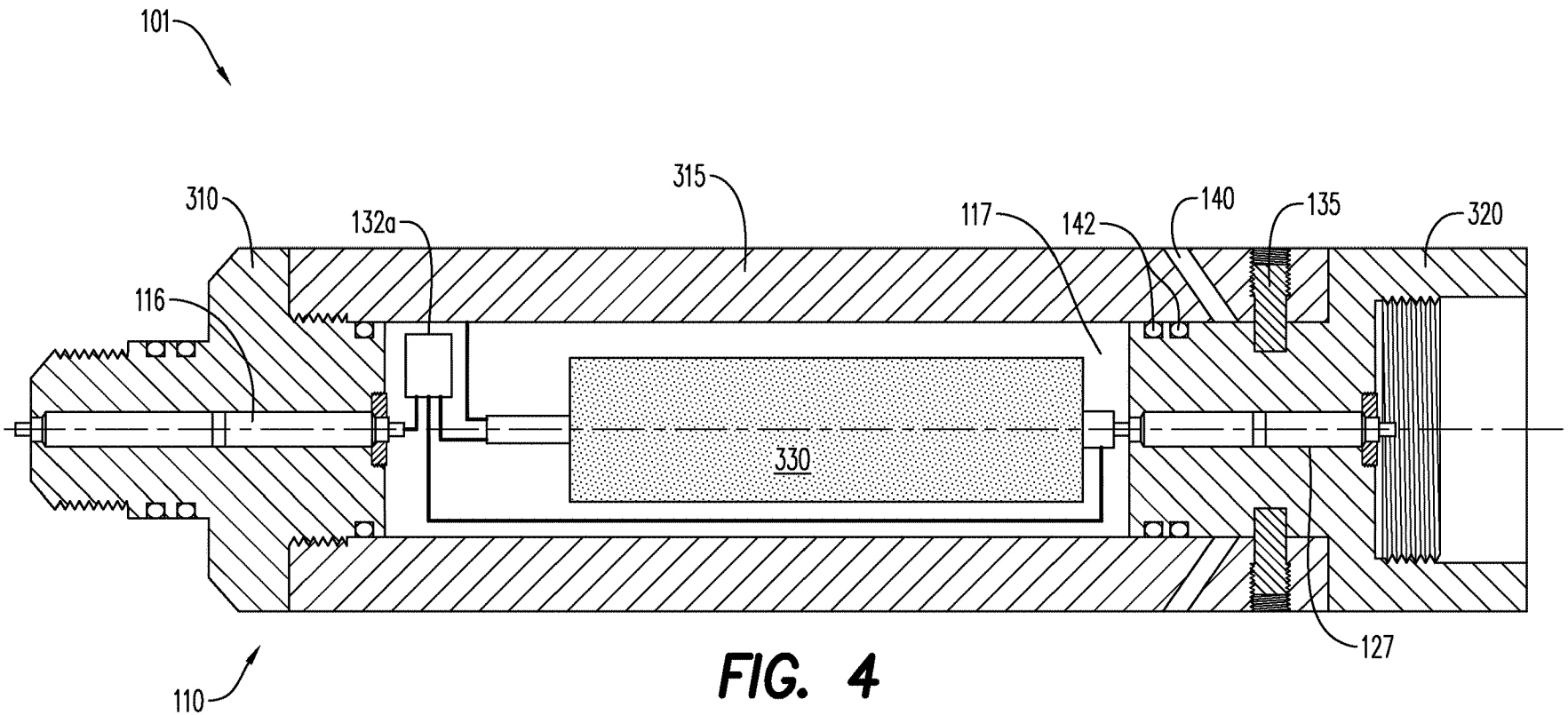
FIG. 4 is a cross-sectional view of still another exemplary wireline release tool, according to an embodiment.

In some embodiments, for example as shown in FIG. 3A, the first or upper housing portion 110 may include a first connector 310 that seals one of the open ends of the casing 315, and the first connector 310 may be attached to the casing 315 more securely than the second or lower housing portion 120 (e.g. with a stronger connection than the shearing element which attaches the second or lower housing portion 120 to the first or upper housing portion 110). In some embodiments, the shearable element 135 may be received within a shear element 135 receptacle/cavity (e.g. in the housing), and upon shearing of the shearable element 135, the shear element 135 receptacle may be configured to engage with an overshot fishing tool.

In some embodiments (not shown), the two portions of the housing may be reversed from the description above. For example, the lower housing portion 120 (which may be configured for attachment to the tool string) may have an open end and a closed end, and the upper housing portion 110 (which may be configured for attachment to the wireline) may be disposed at the open end and releasably (e.g. shearably) attached to the open end to close/seal the open end and form the enclosed chamber 117. Similar to the embodiments described above with respect to FIG. 1, a gas generator 130 may be disposed in the chamber 117. Upon activation of the gas generator 130, the pressure in the chamber 117 may separate the upper and lower housing portions. Some embodiments may likewise have dampening ports 140 and seals 142 configured to vent gas from the chamber 117 to the external wellbore environment once the housing portions move from the initial position to the venting position. The dampening ports 140 may be configured to dampen recoil upon separation of the housing portions (e.g. at the release position). For example, the dampening ports 140 may be directed uphole and/or away from the tool string.

Figure 2:
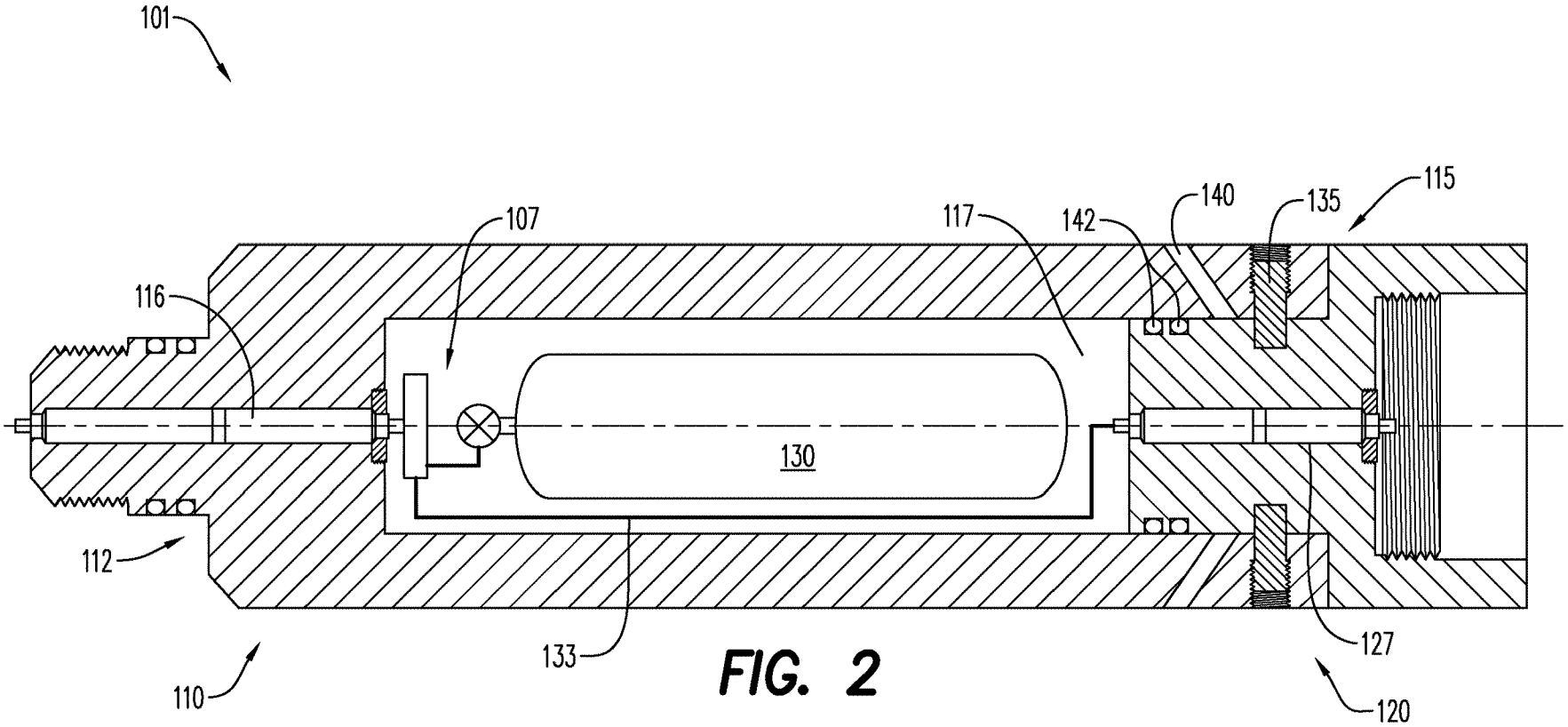
FIG. 2 is a cross-sectional view of another exemplary wireline release tool, according to an embodiment.

Additional exemplary embodiments will now be introduced according to FIGS. 3A to 5*d* (which may be similar in many ways to FIGS. 1-2). While FIGS. 1-2 illustrate the upper housing as a single, integral, unified upper housing, FIGS. 3A-5*d* illustrate an embodiment in which the upper housing portion 110 (e.g. the first housing portion) is formed of a first connector 310 securely and sealingly attached to a casing 315 to form a closed end 112 of the upper housing portion 110. Further, the lower housing portion 120 in FIGS. 3A-5*d* (e.g. the second housing portion) may include or be a second connector 320. For example, the upper housing portion 110 may include a casing 315, with a chamber 117 extending longitudinally therethrough, and a first connector 310 securely fixed to an upper end of the casing 315 (e.g. to form the closed end 112 of the upper housing portion 110). The first connector 310 may be configured for attachment to a wireline. The second housing portion may include a second connector 320, which may be configured for attachment to a tool string. The first bulkhead 116 may extend through the first connector 310, and the second bulkhead 127 may extend through the second connector 320. In some embodiments, the first and second bulkheads may each include sealing elements/seals (such as o-rings), to prevent fluid communication between the chamber 117 and the external wellbore environment through the respective housing portions at the interface with the bulkheads.

The gas generator 130 may be disposed in the chamber 117 between the first connector 310 and the second connector 320 (e.g. with the chamber 117 in the initial position sealingly enclosed within the casing 315 between the first connector 310 and the second connector 320). In the initial position, the second connector 320 may be fixed to the housing by a shearable element 135. The first connector 310 may be securely attached to the casing 315 more securely/strongly than the shearable attachment of the second connector 320 to the casing 315 (e.g. so that upon shearing of the second connector 320 attachment, the first connector 310 remains attached to the casing 315). Upon shearing of the shearable element 135, the second connector 320 may be slidable with respect to the casing 315 between the initial position, in which the second connector 320 closes the second/open end 115 of the chamber 117, and a release position in which the second connector 320 no longer closes the second end of the chamber 117.

Figure 3B:
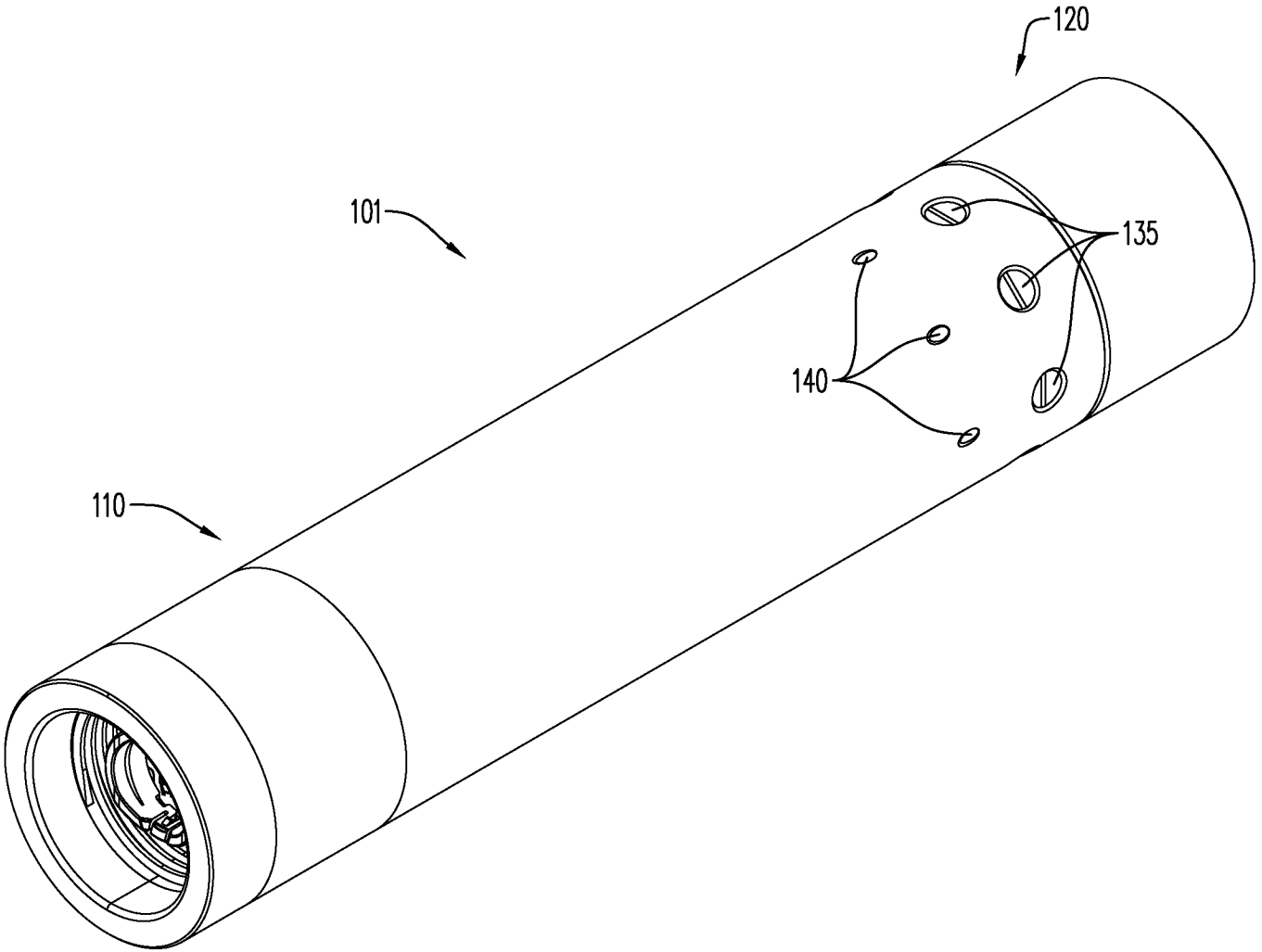
FIG. 3B is an isometric view of the wireline release tool of FIG. 3A.
Figure 3C:
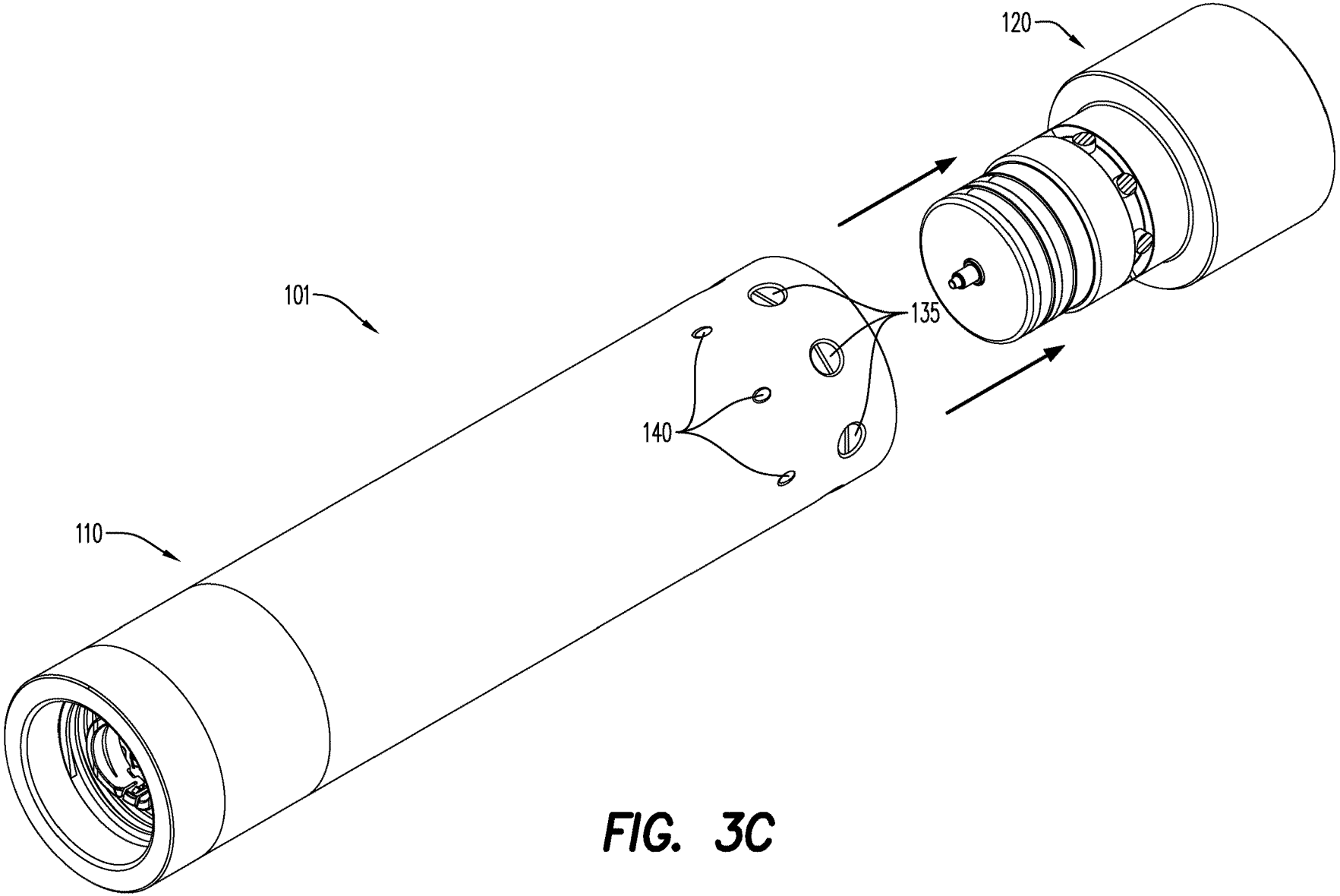
FIG. 3C is an exploded isometric view of the wireline release tool of FIG. 3A.

FIG. 3A is a cross-sectional view of a power charge driven release tool (e.g. in which the gas generator comprises a power charge 330) including an electronic igniter 132, according to an embodiment. For example, the electronic igniter 132 may be disposed in the chamber 117, along with the power charge 330. The electronic igniter 132 may be configured to ballistically activate the power charge 330. FIG. 3B is an isometric view of the wireline release tool of FIG. 3A, and FIG. 3C is an exploded isometric view of the wireline release tool of FIG. 3A, in which the lower housing portion 120 is removed from the upper housing portion 110 (e.g. after the power charge has generated sufficient gas pressure to shear the shearable element 135 and move the lower housing portion 120 to the release position. FIG. 4 is a cross-sectional view of a power charge 330 driven release tool including a switch and igniter (which may be disposed in the chamber 117), according to an embodiment. It is contemplated that the release tool 101 may be used with different tool string components, such as perforating guns, weight bars, setting tools, and the like. Temperature rating of the tool may be dependent on the temperature rating of the power charge 330.

According to FIGS. 3A and 4, the power charge driven wireline release tool 101 includes a housing configured to receive the power charge 330. The housing may include a casing 315 having a first open end (e.g. the upper open end), a second open end (e.g. the lower open end), and a chamber 117 extending longitudinally therebetween. The housing may also include a first connector 310 and a second connector 320, which may close the open ends of the casing 315. In some embodiments, at least one dampening port/vent channel/ventilation channel may extend from an outer surface of the second connector 320 (e.g. from an inner surface of the casing 315, for example at the interface of the second connector 320 and the casing 315), through an outer wall of the housing, and to an area external to the chamber 117 of the housing (e.g. the external wellbore environment).

The power charge 330 is disposed in the chamber 117 that extends between the first open end and the second open end. In an aspect, the chamber 117 is pressure sealed (e.g. in the initial position, when the second connector 320 is shearingly attached to the casing 315). For example, there may be sealing elements/seals located at the interface of the first connector 310 and the casing 315, as well as one or more seal elements 142 at the interface of the second connector 320 and the casing 315. According to an aspect, the wall of the housing may be thicker than a typical wall thickness of a wireline release tool 101 so that the housing can withstand the upcoming pressure and so that the housing can resist deformation due to pressure in the wellbore. According to an aspect, the wall of the housing (such as the casing 315) may have a thickness of approximately 0.2 to 0.8 inches or approximately 0.2 to 0.4 inches. In some embodiments, the housing may be constructed of materials, such as steels, of the type typically used for downhole tools such as wireline release tools. This may help to ensure that the release tool can be safely retrieved from the wellbore using an overshot well fishing tool. Similarly, the secure attachment of the first connector 310 to the casing 315 may be sufficiently strong to withstand the upcoming pressure and to resist deformation due to pressure in the wellbore. As noted above, although not shown in the figures, some embodiments of the wireline release tool 101 may employ a reverse configuration, in which the first connector 310 is shearingly attached to the casing 315, while the second connector 320 is securely attached to the opposite end of the casing 315, and such embodiments are also within the scope of this disclosure.

As illustrated in FIG. 2, for example, alternative to the power charge 330, a pressurized gas container can be installed that is actuated by an electronic valve 107 to release a pressurized gas in the sealed interior of the chamber 117 to pressurize the interior of the housing chamber 117.

An activator, such as an igniter 132, may be positioned in the chamber 117, for example in proximity to the first open end and/or the first connector 310 such that it is in ballistic communication with the power charge 330. According to an aspect, the igniter 132 is an electronic igniter (FIG. 3A). The electronic igniter may be configured substantially as described in International Application No. PCT/EP2020/085622 filed Dec. 10, 2020, which is commonly owned by DynaEnergetics Europe GmbH titled INITIATOR HEAD WITH CIRCUIT BOARD, which is incorporated herein by reference in its entirety to the extent that it is not incompatible with the express disclosure herein. Alternatively, the igniter 132 may be a conventional igniter that is connected to a switch (jointly shown as 132*a* in FIG. 4). In any event, the igniter 132 may be disposed within a portion of the chamber 117 that extends between the first open end and the second open end.

The first connector 310 is coupled to the first open end of the casing 315 by any coupling mechanism (such as threads, friction fit, welding, and the like). The first connector 310 houses the first bulkhead 116 assembly to help transfer electrical signals between electrical components. The first connector 310 includes a cable end that connects to a wireline cable and a connector end that connects to the first open end of the casing 315. The first bulkhead 116 assembly may extend through the first connector 310 and/or may be configured to provide electrical communication between the wireline and the igniter.

The second connector 320 (which may be configured as a connector piston in some embodiments) is coupled (e.g. shearingly) to the second open end 115 of the casing 315. The second bulkhead 127 assembly is positioned in the second connector 320 (e.g. extending therethrough and/or configured to electrically connect the feedthrough 133 to the tool string). When operating the gun string, a signal (i.e., electrical signal) may be transmitted to initiate the release tool and/or to operate the tool string. In an aspect, the signal may bypass the release tool without activating it (e.g. if the signal is not for activating the release tool, but is instead for operating the tool string below) through a feedthrough 133 that connects to the bulkhead in the second connector 320 for transmission of the signal towards the tool string downhole. This can be solved via an electric switch or by an electronic circuit inside an initiation device (the igniter). An alternative design of the release tool with a gas generator 130 may have an electric valve that can bypass the signals to the gun string below.

The second connector 320 includes a contact surface that engages an inner surface of the housing, at the second open end 115. According to an aspect, the second connector 320 (e.g. connector piston) is coupled to or connected to the second housing portion by at least one shear element 135. The shear element 135 may include shear pins, shear screws, shear bolts, shear rings, and the like. According to an aspect, the shear element 135 serves as an adjustable weak point in the system and can be adjusted (through, for example, an increase or decrease number of pins, screws, rings, bolts, etc.), change material used to make the shear element 135 and/or change dimension (e.g., diameter) of the shear element 135 in order to release at a certain predefined or calibrated force. In some embodiments, this force would be higher than the expected pulling force throughout the wireline run, but lower than the breaking point of the wireline cable. According to an aspect, the shear element 135 may be composed of a metal, for example, brass or steel. With the known diameter and material properties, an exact weak point value can be determined based on the needs of the application. According to an aspect, the weak point can be calculated by the operator of the wireline tool string, to match different breaking points of different cable types and cable diameters.

The second connector 320 may include a threaded receptacle (or other connection mechanism) that is configured to engage with different tool string components, such as perforating guns, weight bars, setting tools, and the like. The threaded receptacle can be adjusted to secure any selected tool string component. While the threaded receptacle is illustrated including a continuous thread, it is contemplated that the threads may be discontinuous.

Figure 5A:
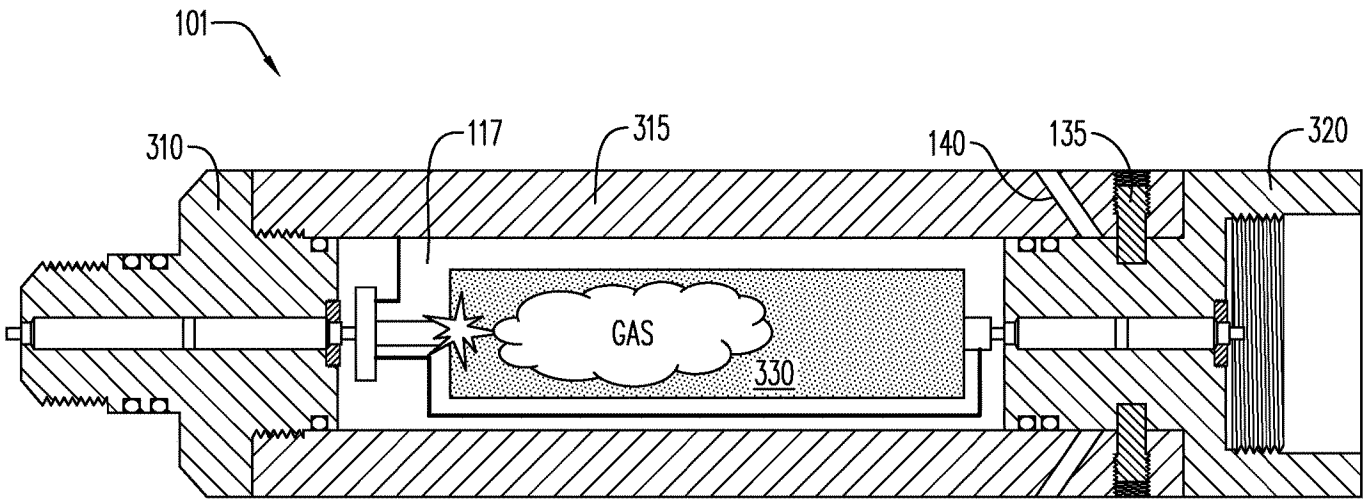
FIGS. 5A-5D are cross-sectional views of an exemplary wireline release tool in use, according to an embodiment.
Figure 5B:
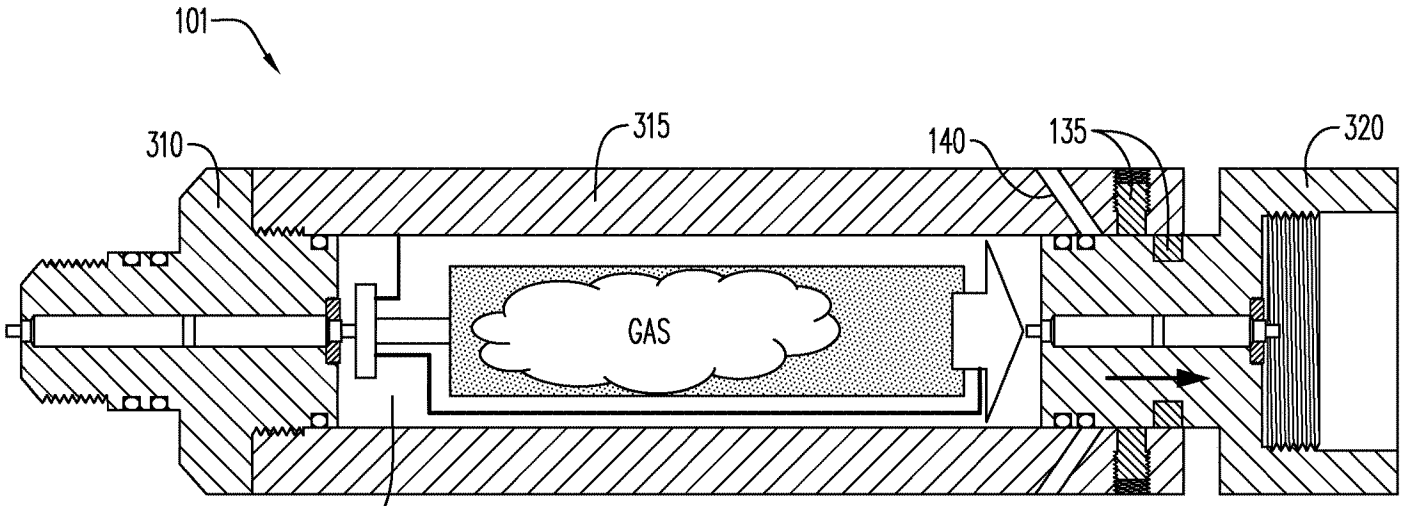
Figure 5C:
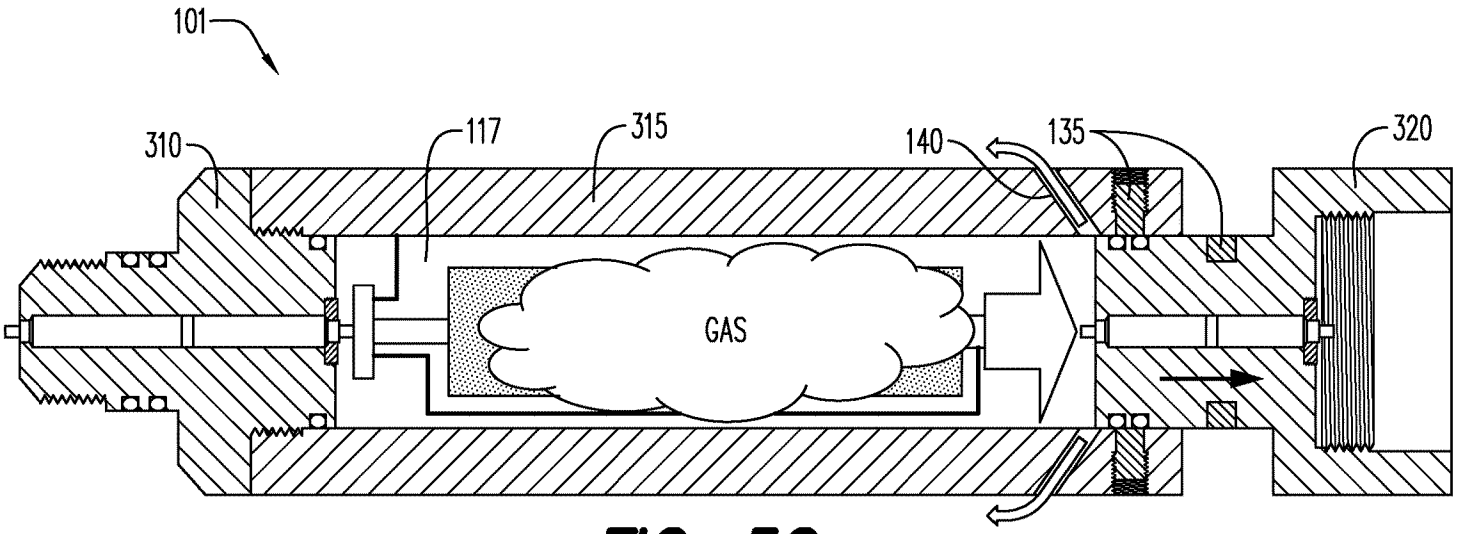
Figure 5D:
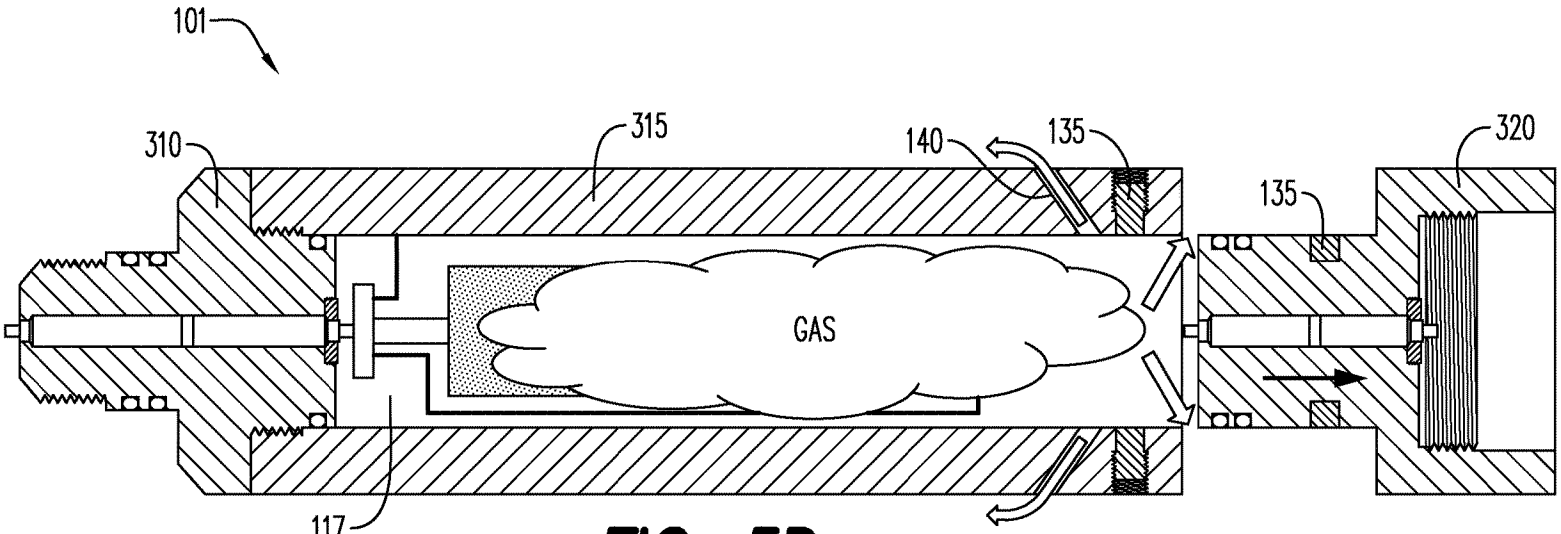

FIGS. 5A-5D illustrate operation of an exemplary wireline release tool 101 (e.g. in which gas pressure pushes the lower housing portion 120/second connector 320 from an initial position to a venting position, and a release position). FIG. 5A is a cross-sectional view of an exemplary power charge driven release tool in a first (e.g. initial) position (e.g. in which the second connector 320/lower housing portion 120 seals the chamber 117 and is held in place by shearable element 135), illustrating initiation of a power charge 330, and start of gas generation and pressure buildup, according to an embodiment. FIG. 5A shows the release tool 101 once the power charge 330 has been initiated. A gas pressure forms in the chamber 117 (contained therein by the seal elements provided between the housing and each of the first connector 310 and the second connector 320), and the gas pressure inside the chamber 117 rises by burning the power charge 330. The increased chamber pressure forces the second connector 320/lower housing portion 120, which also serves as a piston, from the second open end 115 of the casing 315. The gas pressure contact surface of the piston is designed to be wide, to allow the internal chamber pressure to build up a high force on the piston/second connector 320. The second connector 320/connector piston is retained by one or more shear element 135 (e.g. shear pins, shear screws, shear bolts, shear rings etc.) in the initial position. The first connector 310 is securely coupled to the housing so that the internal chamber 117 pressure does not cause the first connector 310 to move relative to the housing. For example, the first connector 310 may be coupled to the casing 315 more securely than the second connector 320 is and/or with sufficient strength to remain securely fixed while experiencing/resisting the gas pressure within the chamber 117 (e.g. thereby closing the first open end 115 of the casing 315 throughout the process).

FIG. 5B is a cross-sectional view of the power charge 330 driven release tool of FIG. 5A in a second position, illustrating the shear element 135*s* after they have been sheared (e.g. by the force of the gas pressure in the chamber 117 pushing on the gas pressure contact surface of the second connector 320). Once the sheared elements have been sheared, it allows the second connector 320 and the tool string connected thereto to move (e.g. slide, for example in a downward direction) away from the casing 315. In an aspect, in this position, the second connector 320 may be connected (e.g. by contact, but not by the shear elements) to the casing 315 and the contact surface and seal elements of the second connector 320 may still be engaged with the inner surface of the housing. Since the seal elements of the second connector 320 are still disposed between the chamber 117 and the dampening ports 140/ventilation channels, there is still no fluid communication therebetween at this stage. Since the shear elements 135 have been sheared at this stage, the gas pressure acting on the gas pressure contact surface of the second connector 320 may push the second connector 320 in a direction away from the casing 315 and/or the first connector 310 (e.g. downward).

FIG. 5C is a cross-sectional view of the power charge driven release tool 101 of FIG. 5A in a third (e.g. venting) position, illustrating pressure moving the piston in a further downward direction and/or away from the casing 315, so that dampening ports 140/ventilation channels formed in the housing are opened to facilitate an exit for some of the gas to leave the release tool chamber 117 (e.g. fluid communication between the chamber 117 and the external wellbore environment). As illustrated in FIG. 5C and FIG. 5D, after shearing the shear element 135 with the gas pressure and driving the second connector 320 downward beyond the dampening ports 140/vent channels, the chamber 117 is in open communication with the dampening ports 140/vent channels and gas can escape through vent channels (e.g. as the second connector 320 moves between the vent position and the release position). In an aspect, the dampening ports 140/vent channels may be formed in the housing wall and extend through the housing wall so that each dampening port/vent channel extends radially from the chamber 117 to the exterior of the housing at an angle directed away from the second connector 320. The movement of the gas pressure is directed in the opposite direction of tool movement (that is, in an uphole direction) to reduce the inner pressure of the chamber and reduce the velocity of the casing 315 and the second connector 320 of the release tool. The dampening ports 140/vent channels work as a recoil dampener/break/counter force and therefore reduce the movement/shock/recoil of the tool and the resulting impact on the cable connected to the first connector 310 because the tool is first accelerated towards the cable (ventilation channels pointing in the opposite direction), then it will fall downhole (down the well) and is then caught by the cable. FIG. 5D illustrates a fourth (e.g. release) position, in which the gas pressure may push the second connector 320 sufficiently to separate the second connector 320 from the casing 315. By separating the upper housing portion 110 (e.g. the first connector 310 and the casing 315) from the lower housing portion 120 (e.g. the second connector 320 or connector piston), the wireline may be removed from the well, even if the tool string (or some portion thereof) is stuck. In such instances, the upper housing portion 110 may be removed from the well with the wireline, and the lower housing portion 120/second connector 320 may remain attached to the tool string and/or remain in the well with the tool string.

When released, the tool string that was left behind can be retrieved to the surface by an overshot fishing tool that may grab the tool string at its rounded surface (that is, the portion of the tool string that would be connected to the threaded receptacle). Alternatively, the groove/cavity in which the shear element(s) 135 sit/are located can act as a fishing profile and allow for an overshot fishing tool to latch on.

While FIGS. 3A-5D illustrate embodiments of the wireline release tool 101 in which the first connector 310 is separate but attachable to the casing 315 to form the upper housing, in other embodiments the first connector 310 and the casing 315 may be a single integral element (e.g. permanently attached and/or formed from a single unitary/monolithic piece of material, for example as shown in FIG. 1).

Figure 6:
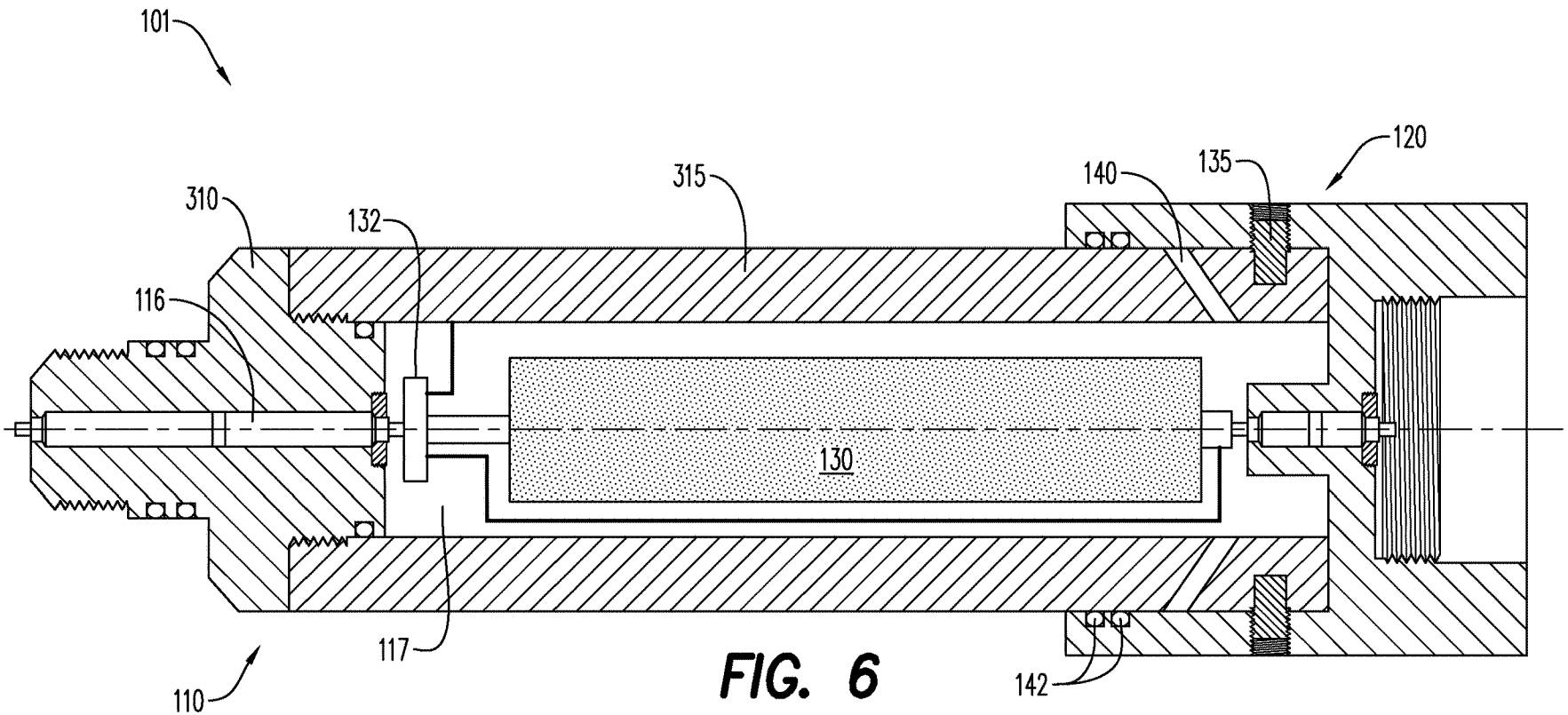
FIG. 6 is a cross-sectional view of yet another exemplary wireline release tool, according to an embodiment.

FIG. 6 illustrates a wireline release tool 101 similar to FIG. 1 in which the lower housing portion 120 is configured to slidingly interact with the lower/open end 115 of the upper housing portion 110 by encompassing the lower open end 115. For example, the one or more seals 142 may be disposed on the interior surface of the lower housing portion 120. FIG. 6 illustrates the tool in its initial position, with the one or more seals 142 disposed above the dampening ports 140 (e.g. above the outer vent openings of the dampening ports 140) and/or in position to prevent fluid communication between the chamber 117 and the external wellbore environment and with the shearable element 135 holding the lower housing portion 120 (e.g. second connector 320) in place closing/sealing the chamber 117. In FIG. 6, the one or more shearable element 135 may span between the exterior surface of the upper housing portion 110 and the interior surface of the lower housing portion 120 (e.g. forming an interference lock that prevents movement until such time as the shearable elements 135 are sheared).

Figure 7:
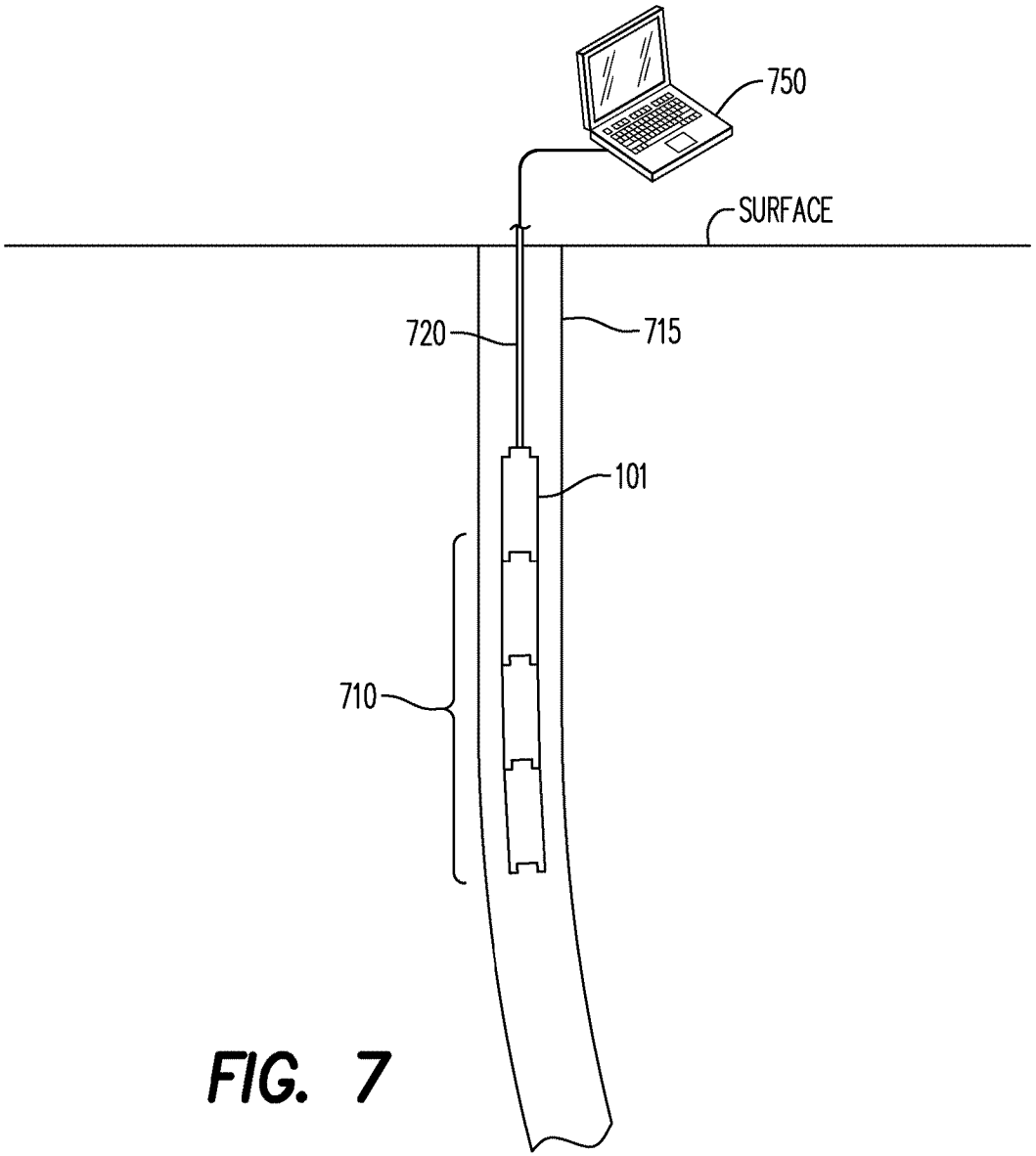
FIG. 7 is a schematic diagram of an exemplary wireline release tool disposed in a well, according to an embodiment.

FIG. 7 illustrates an exemplary tool string 710 disposed in a well 715. The tool string 710 is held in the well 715 and/or operated using a wireline 720 from the surface. An exemplary wireline release tool 101 may be used to connect the wireline 720 to the tool string 710. For example, the wireline 720 may be attached to the top of the wireline release tool 101, and the tool string 710 may be attached to the bottom of the wireline release tool 101. In some embodiments, the wireline 720 may be coupled to the upper housing portion 110 (e.g. the first connector 310), and the tool string 710 may be connected to the lower housing portion 120 (e.g. the second connector 320). Electrical signals from the surface (e.g. from a computer 750 located at the surface) may allow for operation of the tool string 710 (for example via the feedthrough 133 and bulkheads in the wireline release tool 101), without activating the wireline release tool 101 to separate. An electrical activation signal from the surface (e.g. from the computer 750 at the surface) may activate the wireline release tool 101, for example causing the activator to activate the gas generator 130 in order to separate the wireline 720 from the tool string 710. For example, the housing of the wireline release tool 101 may separate, with the upper housing portion 110 remaining attached to the wireline 720, the lower housing portion 120 remaining attached to the tool string 710, and/or the upper and lower housing portions no longer coupled (e.g. now separated). In some embodiments, the tool string 710 may include one or more of the following: logging equipment, one or more perforation guns, one or more jet cutters, one or more fracturing tools, one or more acidizing tools, one or more cementing tools, one or more production enhancement tools, one or more completion tools or any other tool capable of being coupled to a downhole string for performing a downhole well operation.

Embodiments of the disclosure are also associated with a method for releasing a tool string within a wellbore. For example, the method may include the following steps: providing a wireline release tool (e.g. such as described herein) disposed between a wireline uphole and the tool string downhole (wherein the wireline release tool and the tool string are disposed within the well); receiving an activation signal from the surface (e.g. for the wireline release tool to generate gas within its chamber, which may occur upon a part of the tool string becoming stuck within the well); responsive to the activation signal, generating gas pressure within the chamber of the wireline release tool; shearing, by generated gas pressure in the chamber of the wireline release tool in response to the activation signal, the shearable element of the wireline release tool; and pushing, by the generated gas pressure within the chamber, the lower housing portion away from the open end of the upper housing portion. In some embodiments, generating gas may comprise activating an igniter configured to (ballistically) activate a power charge. In some embodiments, generating gas may comprise opening a valve for a gas container disposed within the chamber of the tool.

In some embodiments, before gas generation, the pressure within the chamber may be less than the external wellbore pressure (e.g. outside the wireline release tool). In some embodiments, there may be a pressure differential (e.g. between the chamber and the external wellbore environment) before activation of the gas generator. The generated gas pressure may be sufficient to shear the shearable element, overcome the external pressure of the wellbore (e.g. the pressure differential), and push the lower housing portion until separation from the upper housing portion occurs.

In some embodiments, as the lower housing portion moves from the initial position towards the release position (e.g. at the venting position), venting generated gas in the chamber externally at an angle uphole (e.g. away from the lower housing portion) to dampen shock during release. For example, the generated gas pressure may push the lower housing portion downward, moving the seals (e.g. below the vent/nozzle openings) to open communication between the chamber and the external wellbore environment through the dampening ports.

Some embodiments may further include one or more of the following steps: making up the tool string and connecting it to the wireline via the wireline release tool, running the tool string downhole (via wireline), operating the tool string via signals from the surface—e.g. with the wireline release tool passing through signals to the tool string, and/or receiving a signal from the surface (with pass through of the signal for downhole use of the tool string). Typically, pass through of signals from the surface to the tool string would occur before the tool string is stuck and/or before activation of the wireline release tool to separate/detach the tool string from the wireline.

In some embodiments, disclosed wireline release tool embodiments may provide for less recoil/shock, for example reducing the chances that the wireline may be damaged during the release process. In some embodiments, disclosed wireline release tool embodiments may provide improved reliability. For example, the tool may be more durable and/or simpler to manufacture and/or operate. In some embodiments, the wireline release tool embodiments may allow for separation/release without the need to first pressure equalize (e.g. before pushing the housing portions apart). In some embodiments, disclosed wireline release tool embodiments may provide for improved retrieval (e.g. fishing out) of the tool string. In some embodiments, the tool embodiments may provide for improved electrical/signal reliability.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Approximating language, as used herein throughout the specification and claims, may be applied to modify any quantitative representation that could permissibly vary without resulting in a change in the basic function to which it is related. Accordingly, a value modified by a term such as "about" or "approximately" is not to be limited to the precise value specified. Such approximating language may refer to the specific value and/or may include a range of values that may have the same impact or effect as understood by persons of ordinary skill in the art field. For example, approximating language may include a range of +/−10%, +/−5%, or +/−3%. The term "substantially" as used herein is used in the common way understood by persons of skill in the art field with regard to patents, and may in some instances function as approximating language. In some instances, the approximating language may correspond to the precision of an instrument for measuring the value.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A wireline release tool for use in a wellbore, comprising:

a casing having a first end, a second end, and a longitudinally extending chamber extending between the first end and the second end;

a first connector coupled to the first end and configured for attachment to a wireline;

a second connector disposed at the second end and configured for attachment to a tool string;

a shearable element coupling the second connector to the second end; and a gas generator disposed in the chamber between the first connector and the second connector, wherein:

the chamber is enclosed within the casing between the first connector and the second connector;

upon shearing of the shearable element, the second connector is slidable with respect to the housing between an initial position, in which the second connector closes the second end of the casing, and a release position in which the second connector no longer closes the second end of the casing; and the gas generator is configured to generate a gas pressure in the chamber greater than an external pressure outside the wireline release tool within the wellbore, wherein the generated gas pressure is sufficient to shear the shearable element such that the second connector is forced from the initial position to the release position.

2. The wireline release tool of claim 1, wherein the gas pressure generated is sufficient to overcome a pressure differential between the chamber and an external wellbore environment, in addition to shearing the shearable element and moving the second connector from the initial position to the release position.

3. The wireline release tool of claim 1, further comprising:

an activator configured to activate the gas generator in response to receiving an activation signal from a ground surface above the wellbore via the wireline, wherein, before activation of the gas generator, the pressure inside the wireline release tool is less than an external wellbore pressure.

4. The wireline release tool of claim 3, wherein the wireline release tool is configured so that there is no pressure equalization between the chamber and the external wellbore pressure before activation of the gas generator.

5. The wireline release tool of claim 1, wherein the first connector and the casing are formed as a single, integral element.

6. The wireline release tool of claim 1, further comprising:

one or more dampening ports extending from the chamber through an outer wall of the casing, wherein the one or more dampening ports are angled to vent away from the second connector; and one or more sealing elements positioned between the casing and the second connector, wherein in the initial position, the one or more sealing elements prevent fluid communication between the chamber and an external wellbore environment via the one or more dampening ports, and in a venting position disposed between the initial position and the release position, the one or more sealing elements allow fluid communication between the chamber and the external wellbore environment via the dampening ports.

7. The wireline release tool of claim 6, wherein the one or more dampening ports are configured to dampen recoil during separation of the second connector from the casing.

8. The wireline release tool of claim 1, wherein the gas pressure from the gas generator provides the only force acting to move the second connector from the initial position to the release position.

9. The wireline release tool of claim 1, further comprising:

an electrical signal feedthrough configured to pass an electrical signal from the surface via the wireline through the wireline release tool, wherein the first connector comprises a first bulkhead extending therethrough, and the second connector comprises a second bulkhead extending therethrough.

10. The wireline release tool of claim 3, wherein the gas generator is a power charge, and the activator is an igniter.

11. The wireline release tool of claim 3, wherein the gas generator is a gas container holding gas under pressure, and the activator is configured to open the gas container in response to receiving the activation signal.

12. A wireline release tool for use in a wellbore, comprising:

an upper housing portion having a closed end, an open end, and a chamber therebetween;

a lower housing portion disposed to close the open end of the upper housing portion; and a gas generator disposed in the chamber between the closed end of the upper housing portion and the lower housing portion, wherein:

the lower housing portion is shearably attached to the open end of the upper housing portion and configured to close the open end;

upon shearing, the lower housing portion is slidable with respect to the upper housing portion between an initial position, in which the lower housing portion closes the open end of the upper housing portion, and a release position in which the lower housing portion no longer closes the open end of the upper housing portion; and the gas generator is configured to generate a gas pressure in the chamber greater than an external wellbore pressure, wherein the generated gas pressure is sufficient to shear and to force the lower housing portion from the initial position to the release position.

13. The wireline release tool of claim 12, wherein:

the upper housing portion further comprises one or more dampening ports extending from the chamber through an outer wall of the upper housing portion;

the one or more dampening ports are angled uphole; and the lower housing portion comprises one or more seal elements configured so that, in the initial position, the one or more seal elements prevent fluid communication between the chamber and an external wellbore environment via the one or more dampening ports, and in a venting position disposed between the initial position and the release position, the one or more seal elements allow fluid communication between the chamber and the external wellbore environment so that gas pressure from the gas generator may exit the chamber through the one or more dampening ports.

14. The wireline release tool of claim 12, wherein the gas pressure generated is sufficient to overcome a pressure differential between the chamber and an external wellbore environment.

15. The wireline release tool of claim 12, wherein the upper housing portion is configured for attachment to a wireline, the wireline release tool further comprising an activator configured to activate the gas generator in response to receiving an activation signal from the surface via the wireline wherein, before activation of the gas generator, the pressure inside the wireline release tool is less than the external wellbore pressure.

16. The wireline release tool of claim 12, wherein:

the upper housing portion comprises a casing with a chamber extending longitudinally therethrough and a first connector securely fixed to an upper end of the casing;

the first connector is configured for attachment to a wireline;

the second housing portion comprises a second connector; and the second connector is configured for attachment to a tool string;

wherein:

before activation of the gas generator, the pressure inside the wireline release tool is less than an external wellbore pressure; and the wireline release tool is configured so that there is no pressure equalization between the chamber and the external wellbore environment before activation of the gas generator.

17. A wireline release tool for use in a wellbore, comprising:

a first housing portion having a closed end, an open end, and a chamber therebetween;

a second housing portion disposed to close the open end of the first housing portion; and a gas generator disposed in the chamber between the closed end of the first housing portion and the second housing portion;

wherein:

the second housing portion is shearably attached to the open end of the first housing portion and configured to close the open end;

upon shearing, the second housing portion is slidable with respect to the first housing portion between an initial position, in which the second housing portion closes the open end of the chamber first housing portion, and a release position in which the second housing portion no longer closes the open end of the first housing portion;

the gas generator is configured to generate gas pressure in the chamber sufficient to overcome a pressure differential between the chamber and an external wellbore environment and to shear and force the second housing portion from the initial position to the release position;

the first housing portion further comprises one or more dampening ports extending from the chamber through an outer wall of the first housing portion;

the one or more dampening ports are configured to be angled uphole;

the wireline release tool further comprises one or more seal elements configured so that, in the initial position, the one or more seal elements prevent fluid communication between the chamber and the external wellbore environment via the one or more dampening ports, and in a venting position disposed between the initial position and the release position, the one or more seal elements allow fluid communication between the chamber and the external wellbore environment so that gas pressure from the gas generator may exit the chamber through the dampening ports.

18. The wireless release tool of claim 17, further comprising an activator configured to activate the gas generator in response to receiving an activation signal from the surface via a wireline;

wherein:

before activation of the gas generator, the pressure inside the wireline release tool is less than an external wellbore pressure; and the wireline release tool is configured so that there is no pressure equalization between the chamber and the external wellbore environment before activation of the gas generator.

19. The wireline release tool of claim 17, wherein the first housing portion is configured to be disposed uphole of the second housing portion, the first housing portion is configured for attachment to a wireline, and the second housing portion is configured for attachment to a tool string.

20. The wireline release tool of claim 17, wherein the first housing portion comprises a casing with two open ends and a first connector securely attached to one of the two open ends.

* * * * *